US007131389B1

(12) United States Patent
Hawkes

(10) Patent No.: US 7,131,389 B1
(45) Date of Patent: Nov. 7, 2006

(54) SUBMERSIBLE

(76) Inventor: Graham Hawkes, 27 Oakwood Ct., San Anselmo, CA (US) 94960

( * ) Notice: Subject to any disclaimer, the term of this patent is extended or adjusted under 35 U.S.C. 154(b) by 0 days.

(21) Appl. No.: 10/763,041

(22) Filed: Jan. 22, 2004

(51) Int. Cl.
*B63G 8/14* (2006.01)

(52) U.S. Cl. ..... 114/330; 114/320

(58) Field of Classification Search ..... 114/312, 114/313, 320, 330, 331, 332, 333, 281, 244, 114/216
See application file for complete search history.

(56) References Cited

U.S. PATENT DOCUMENTS

| | | | | |
|---|---|---|---|---|
| 1,286,679 | A | 12/1918 | Longobardi | |
| 1,421,369 | A | 7/1922 | Ardo | |
| 1,785,620 | A * | 12/1930 | Frise | 244/216 |
| 2,720,367 | A * | 10/1955 | Doolittle | 114/313 |
| 2,929,346 | A * | 3/1960 | Perce | 114/330 |
| 3,082,975 | A | 3/1963 | Cardwell et al. | |
| D196,087 | S | 8/1963 | Armstrong et al. | |
| 3,183,871 | A * | 5/1965 | Reder | 114/281 |
| 3,257,982 | A | 6/1966 | Meldrum | |
| 3,416,478 | A | 12/1968 | Markham | |
| 3,463,108 | A * | 8/1969 | Neumeier | 114/313 |
| 3,598,074 | A * | 8/1971 | Schubert | 114/333 |
| 3,650,234 | A | 3/1972 | Goudy | |
| D230,893 | S | 3/1974 | Arruda | |
| 4,577,583 | A | 3/1986 | Green | |
| 4,579,297 | A | 4/1986 | Ayoola | |
| 5,237,952 | A | 8/1993 | Rowe | |
| 5,373,800 | A | 12/1994 | Steinberg | |
| 5,673,645 | A | 10/1997 | Bandyopadhyay | |
| 5,704,309 | A | 1/1998 | Kohnen | |
| D399,183 | S | 10/1998 | Ciamillo | |
| 5,939,665 | A | 8/1999 | Banyopadhyay | |
| 6,276,294 | B1 | 8/2001 | Geriene et al. | |
| 6,321,676 | B1 | 11/2001 | Kohnen et al. | |
| 6,371,041 | B1 | 4/2002 | Ness | |
| 6,474,255 | B1 | 11/2002 | Geriene et al. | |
| D475,964 | S | 6/2003 | Sakas | |
| 2002/0152945 | A1 | 10/2002 | Geriene et al. | |

FOREIGN PATENT DOCUMENTS

| | | |
|---|---|---|
| DE | 197-30-092 | 1/1999 |

(Continued)

OTHER PUBLICATIONS

Mike Osborne, U-Plane— A Lost Opportunity, New Innovative Concept, Engineering Designer, Jul./Aug. 2000, 4 pages.

(Continued)

*Primary Examiner*—Lars A. Olson
(74) *Attorney, Agent, or Firm*—Paul K. Tomita; Dergosits & Noah LLP

(57) ABSTRACT

A winged submersible having a neutral to positive buoyancy utilizes an inverted wing structure to allow the wings to create downward force on the submersible in response to forward movement. Internal pressure pods are provided to allow an occupant to maintain a recumbent sitting position. The pressure pods are maintained at a constant pressure with life support systems, while the remainder of the hull is not pressurized. Acrylic domes are positioned to allow access to each internal pressure pod and when closed, the occupant's head is positioned within the center of the dome for optimal optics under water. Wings with adjustable control surfaces provide the submersible with the ability to roll about a longitudinal axis 0–360 degrees in either direction.

89 Claims, 18 Drawing Sheets

FOREIGN PATENT DOCUMENTS

| | | |
|---|---|---|
| JP | 62-023894 | 1/1987 |
| JP | 62-023895 | 1/1987 |
| JP | 63-279997 | 11/1988 |
| JP | 05-050986 | 3/1993 |
| JP | 06-040386 | 2/1994 |

OTHER PUBLICATIONS

George Kittredge, Kittredge K-250 Conceptual Drawing, Internet: www.psubs.org/store/subplans/kittredge/k250.html, 1 page.
Kent Markham, Do It Yourself Construction Plans, The Delta Wing Submarine, Internet: www.scubatow.com/flash/main.asp, 2 pages.
Kent Markham, Do It Yourself Construction Plans, The Silent Runner 2 (2 man sub), Internet: www.scubatow.com/flash/main.asp, 2 pages.
.
Innespace, Redding CA, Internet: www.innespace.com, 2 pages.
Aquarius, Subeo Ltd., Essex, England, Internet: www.subeo.com /pdf/brochure_aqu.pdf, 2 pages.

About Subeo, Subeo Ltd,. Essex England, Internet: www.subeo. com/inside.htm, 3 pages.

* cited by examiner

SUBMERSIBLE

BACKGROUND OF THE INVENTION

1. Field of the Invention

The present invention generally relates to submersibles and, more particularly, to a winged submersible.

2. Background of the Invention

Conventional submersibles suffer from many deficiencies. One such deficiency is the sole use of variable buoyancy. In the case of catastrophic failure of a variable buoyancy system, the corresponding submersible will generally sink.

Another deficiency is that conventional submersibles maneuver using a static system of ballast adjustment and vectored thrust. The use of such systems result in submersibles that are slow and bulky, and that are without advanced maneuvering capabilities such as, for example, aircraft. As a result, undesirable emergency situations such as, for example, entanglements, can occur with some frequency, and the ability to avoid such situations is diminished.

Yet another deficiency in most recreational submersibles is the lack of comfortable seating position. During extended dives, divers may become quite uncomfortable due to the lack of a comfortable seating position and may correspondingly cut their dive short. Moreover, seating in conventional submersibles is not too secure, as the typical seating arrangement simply involves an individual perching on a seat without any restraints to secure that individual in an acceptable manner. Accordingly, it would be desirable and highly advantageous to have a winged submersible that at least overcomes the above-identified problems of the prior art.

SUMMARY OF THE INVENTION

The problems stated above, as well as other related problems of the prior art, are solved by the present invention. In accordance with one embodiment of the invention, the submersible includes a hull having at least one pressure pod for accommodating at least one person in a recumbent sitting position, and at least one pair of opposing wings disposed on the hull, said wings being movable in opposite directions with respect to each other to provide the submersible with the ability to roll.

According to another embodiment, the submersible includes a hull having at least one pressure pod for accommodating at least one person in a recumbent sitting position and at least one pair of wings disposed on the hull. The at least one pressure pod is maintained at a constant pressure and the constant pressure provides the submersible with a positive buoyancy.

According to yet another embodiment, the submersible includes a hull having at least one pressure pod for accommodating at least one person in recumbent sitting position, at least one pair of adjustable wings disposed on the hull, and at least one buoyancy tank for providing a variable buoyancy. The at least one pressure pod is maintained at a constant pressure, said at least one buoyancy tank combined with said constant pressure of said pressure pod provides the submersible with a variable buoyancy range from neutral to positive.

In accordance with another embodiment, the submersible includes a hull having at least one pressure pod for accommodating at least one person in a recumbent sitting position, at least one pair of wings disposed on the hull. The at least one pressure pod is capable of maintaining a substantially constant pressure.

A further embodiment of the submersible includes a hull having at least one pressure pod made of sand cast aluminum for accommodating at least one person, and at least one pair of adjustable wings disposed on the hull. The at least one pressure pod is maintained at a constant pressure in order to provide the submersible with a fixed buoyancy.

In yet another embodiment, the submersible includes a hull having at least one pressure pod for accommodating at least one person in a recumbent seating position, at least one pair of opposing wing disposed on the hull, and an acrylic dome access hatch to said at least one pressure pod, said acrylic dome access hatch providing access to said at least one pressure pod while the submersible is in the water. The at least one pressure pod is maintained at a constant pressure of 1.0 Atm when said access hatch is closed.

In another embodiment, the submersible includes a hull having at least one pressure pod for accommodating at least one person, at least one pair of wings disposed on the hull, and a life support system connected to the at least one pressure pod for providing life support systems only to the pod. The at least one pressure pod is maintained at a constant pressure thereby providing the submersible with a fixed buoyancy.

These and other aspects, features and advantages of the present invention will become apparent from the following detailed description of preferred embodiments, which is to be read in connection with the accompanying drawings.

DETAILED DESCRIPTION OF THE INVENTION

Figure 1A:
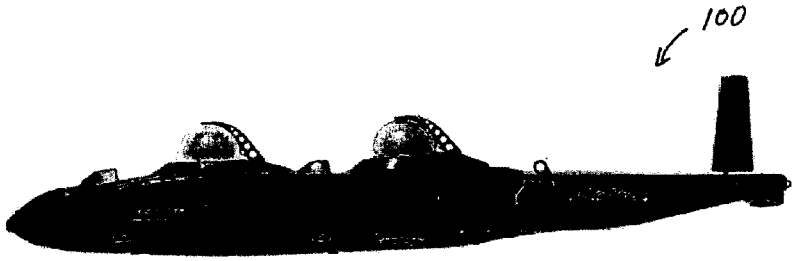
FIGS. 1A–E are diagrams respectively illustrating the left side, top side, under side, front and rear of a winged submersible 100, according to an illustrative embodiment of the present invention.
Figure 1B:
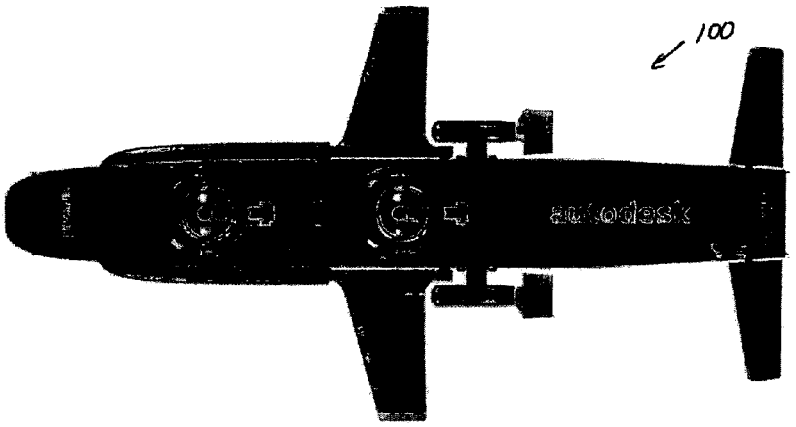

The present invention is directed to a winged submersible. In a preferred embodiment, the winged submersible has a fixed buoyancy, in contrast to conventional submarines and other variable buoyancy submersibles. The fixed buoyancy is obtained by setting the pressure pods of the winged submersible, described in further detail herein below, at a constant pressure. Thus, each of the pods are sealed prior to a dive, and then the pods are set to a constant pressure with the air therein being reconstituted.

Advantageously, in some embodiments of the present invention, the fixed buoyancy system may be implemented to have a positive buoyancy. In the case when the winged submersible according to the present invention is implemented to have a positive buoyancy, balancing down forces are generated by negative lift surfaces that include the main wing surfaces shown and described herein. That is, the hydrodynamic force of water on the main wing surfaces when the submersible is moving forward creates downward forces on the main wing surfaces to counteract the lift provided by the positive buoyancy. In fact, the faster the submersible is moving, the greater the magnitude of the downward forces that are generated. In a preferred embodiment of the present invention, the overwhelming majority of the vertical forces used to operate the submersible are generated by the main wings.

The use of a positive buoyancy provides an inherent safety over variable buoyancy submersibles by ensuring that the winged submersible will rise to the surface in the case of one or more system failures and/or in the absence of any other buoyancy forces such as those provided by variable buoyancy tanks and drop weight systems. It is to be appreciated that while not needed, variably buoyancy tanks and drop weight systems may be incorporated into the winged submersible to meet American Bureau of Shipping (ABS) requirements as well as to provide a capability of stationary loitering to the winged submersible. Moreover, it is to be further appreciated that in some embodiments of the present invention, the fixed buoyancy system may be implemented to have a neutral buoyancy (to allow for stationary loitering).

Moreover, the winged submersible advantageously provides a recumbent seating position for the occupants thereof (as opposed to a prone lying position). Accordingly, the occupants are provided with a more comfortable position during diving than that provided by the prior art, thereby allowing for longer dives without occupant discomfort due to seating position. Further, occupants of the winged submersible may be secured therein, for example, by five-point harnesses, similar to those used in car racing. These and many other advantages of the present invention are described in further detail herein below.

The present invention provides a winged submersible that operates on the principles of dynamic wing forces and flight control, rather than the static system of ballast adjustment and vectored thrust of conventional submersibles. According to a preferred embodiment, the winged submersible is capable of being operated in an inverted position and is further capable of being flown through 360 degrees in a roll or pitch maneuver. Of course, other methods of operation may also be employed by the present invention, while maintaining the spirit of the present invention.

The present invention is particularly suited to specialized, long-range exploration, together with higher speed and advanced maneuvering capability to be used (for example) to study and film large marine animals. Subjects for expeditions include whales, dolphins and porpoises, sharks, seals, sea lions and squids.

In the preferred embodiment of the present invention described herein, the present invention represents a new class of hydro-acrobatic winged craft, or "HAWC-class" submersibles. While conventional minisubs resemble slow, bulky, underwater "dirigibles," the winged submersible according to the present invention reflects, in appearance and concept, a lightweight, high-powered composite airframe with wings, thrusters, and flight controls. In conventional minisubs, a diver is perched on a seat. In the winged submersible according the preferred embodiment, the diver is strapped into his or her seat, preferably using a 5-point harness restraint similar to those used by Indy 500 racecar drivers. A secondary design goal of the winged submersible is to establish a new benchmark for crew comfort and operational safety as appropriate for an audience of "civilian" explorers and adventurers.

The winged submersible may be equipped with numerous safety features, including, for example, emergency airbags for increased floatation, and the ability for pilots to exit the submersible unaided by surface crew.

A description will now be given of some of the advantages and novel features of a winged submersible in accordance with the present invention. It is to be appreciated that the present invention is not solely limited to the specific details and implementations shown in the following figures and corresponding text. That is, given the teachings of the present invention provided herein, one of ordinary skill in the related art will contemplate a winged submersible wherein some of the elements thereof described herein may be omitted and/or substituted, and new elements may be added, all while maintaining the spirit of the present invention. For example, variable buoyancy tanks and drop weight systems may be used in addition to the fixed buoyancy system of the present invention to allow for stationary loitering. As another example, other operation systems may be employed in a winged submersible according to the present invention including, but not limited to, fly-by-wire systems, and so forth. As a further example, a material other than sand-cast aluminum may be used for the pressure pods. In addition, while the preferred embodiment of the present invention contemplates a composite airframe, other materials including, but not limited to, aluminum and titanium, may also be employed for the airframe, while maintaining the spirit and scope of the present invention. Further, while two pods are shown and described with respect to one person per pod, each pod may have more than one person encapsulated therein and, also, the submersible may include a number of pods other than two (e.g., one, three, four, and so forth). These are but some of the many variations capable of being implemented with respect to a winged submersible in accordance with the present invention, given the teachings of the present invention provided herein.

The illustrative embodiment of the winged submersible, as shown, is a two-person craft with individual pressure hull accommodation. The two pressure hulls, or pods are fitted, in tandem, to a low-drag, winged submersible. Other contemplated designs include more than two pressure pods (hulls) to accommodate more than two crewmembers, pressure pods each capable of accommodating more than one crewmember at a given time, a single pressure pod, pods fitted side by side (as opposed to, or in addition to in tandem (e.g., multiple rows of two pods side by side for four, six, or eight seats, etc.)) and so forth.

The crew is housed in a recumbent (sitting) position with standard geometry acrylic spherical sector domes. The body and foot dome of each pressure hull is preferably constructed of commercial grade sand-cast aluminum. Of course, as noted above, other materials may be employed for the pressure hull while maintaining the spirit of the present invention. Moreover, other dome arrangements may also be employed including, but not limited to, a spherical section face plate, part hemisphere, hyper hemisphere, and so forth.

Life support is conventional O2 makeup and CO2 scrubbers, such as, for example, SODASORB™ CO2 scrubbers. Of course, other scrubbers and/or life support elements may be employed, while maintaining the spirit of the present invention.

In the preferred embodiment, the submersible is electric (zero pollution) with external individually compensated lead acid batteries. Of course, other battery compounds and types may also be employed including, but not limited to, silver zinc batteries, fuel cells, and so forth. The main battery bus voltage preferably is reduced from 120 Volt D/C standard (Deep Rover series) to 24 Volt D/C to make the winged submersible intrinsically safer for those performing maintenance on the submersible.

The novel aspects of the winged submersible design make it specialized for longer-range explorations, rather than the typical "manipulator-type" work mode of conventional submersibles. The submersible is streamlined and intended for general operation, preferably trimmed to an "intrinsically safer" positively buoyant condition, with balancing down force generated by negative lift surfaces (main wing surfaces.)

In operation, the pilots "fly" the submersible in a similar manner as a fixed-winged aircraft, rather than operate it under static forces of buoyancy and vectored thrust as in conventional submersibles. In the preferred embodiment, there is a mechanical linkage from the joystick and rudder bars to pitch, roll and heading control surfaces. Each pressurized pod cockpit can be outfitted with a full set of (dual) linked controls. In the preferred embodiment, the thrusters are electronically controlled. Of course, other types of linkages may be employed including, but not limited to, hydraulic, electric, and so forth. Electro-mechanical or hydraulic actuators may then be used to move the wings commanded (slaved to) the position of the controls or slaved to the force input into the controls. Moreover, in some embodiments of the present invention, a single set of controls may be utilized in a "main" cockpit designated for the submersible "pilot". Similarly, the thruster(s) may be controlled by other means, for example, mechanical, electro-mechanical, or other means. Given the teachings of the present invention provided herein, these and other variations will be contemplated by one of ordinary skill in the art, while maintaining the spirit and scope of the present invention.

Above "stall" speed (an estimated 0.5 knots), the submersible operates under dynamic control, using control surfaces to control heading, pitch, roll and so on to maneuver the submersible.

For stationary loitering (when needed), the crew can operate the submersible conventionally, when it is optionally fitted with conventional variable (soft) buoyancy tanks and emergency drop weight system, or when the fixed buoyancy system of the winged submersible is implemented so as to be capable of having neutral buoyancy.

Surface emergency exit may be facilitated by an optional system of inflated ballast bags that provide sufficient excess buoyancy and added stability to float the submersible. Most preferably, surface egress is possible in any sea state.

General specifications of the winged submersible according to an illustrative embodiment of the present invention are provided in Table 1. It is to be appreciated that the present invention is not solely limited to the following specifications and, given the teachings of the present invention provided herein, one of ordinary skill in the related art will contemplate these and other variations of the following specifications, all while maintaining the spirit and scope of the present invention.

TABLE 1

| | |
|---|---|
| Crew | 2 - Pilot/Crew<br>Note: The winged submersible of the illustrative embodiment has redundant controls in both the fore and aft pods, and can be piloted exclusively from either pod. |
| Length Overall | 22 feet |
| Beam (Hull) | 38 inches |
| Wingspan | 12 feet (wings down in flight position) |
| Surface Draft | 28 inches |
| Weight | Approximately 4300 pounds (unmanned) |
| Speed | Approximately 8 knots (may be greater) |
| Thrust | 2X 7hp; 14-inch diameter ducts |
| Maneuvering | Pitch and Roll through 360 degrees (subject to battery restrictions) |
| Outer Hull Construction | Marine foam/resin composite |
| Pressure Pod Construction | Sand-cast and machined aluminum |
| Dome Construction | Cast and machined acrylic (ABS certification rated to 2000 feet) |
| Propulsion Batteries | 24 V 400 amp/hours (2–6 hours battery duration) |
| Lights | Up to six Sea Arc 5000s |
| Camera Fittings | As required |
| Total Payload | 410 pounds |

FIGS. 1A–E are diagrams respectively illustrating the left side, top side, under side, front and rear of a winged submersible 100, according to an illustrative embodiment of the present invention. It is to be appreciated that in some embodiments of the present invention, a canard control (tail first) arrangement may be employed. Similarly, while the illustrative embodiment shows two rudders, other configurations are possible, for example, one or three rudders.

Figure 1C:
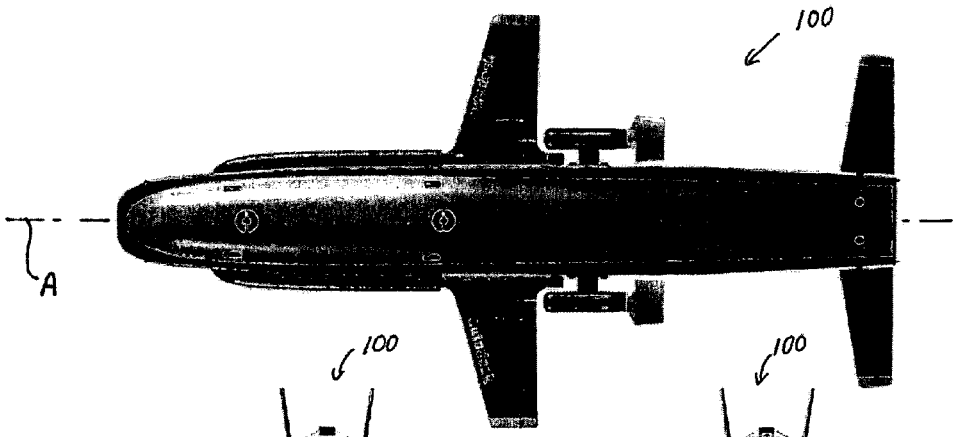
Figure 1D:
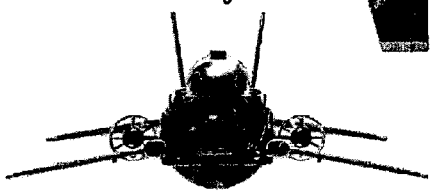
Figure 1E:
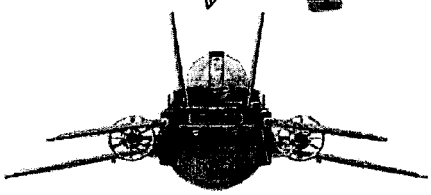
Figure 2:
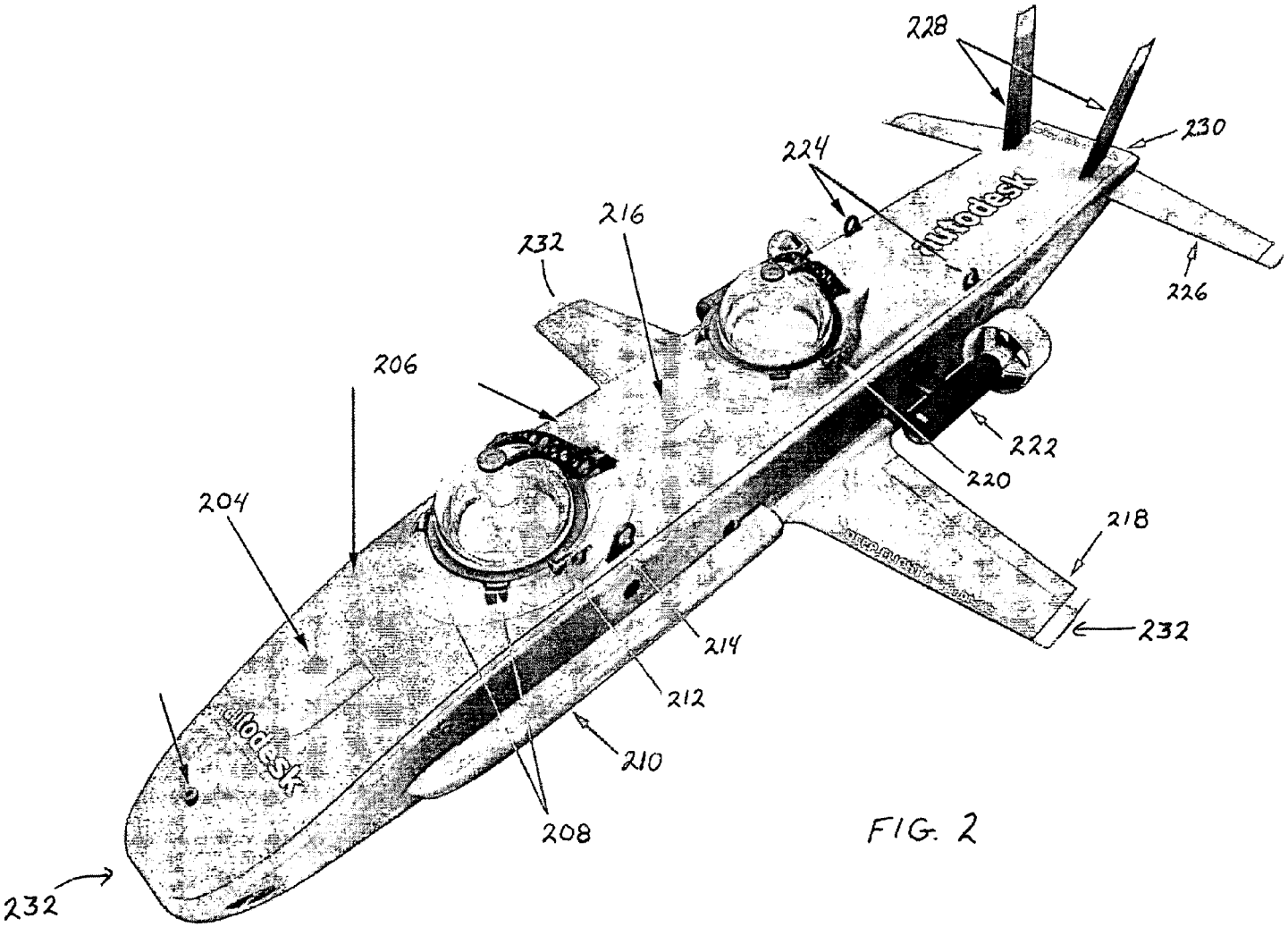
FIG. 2 is a diagram illustrating external details of the winged submersible 100 of FIG. 1, according to an illustrative embodiment of the present invention.

FIG. 2 is a diagram illustrating external details of the winged submersible 100 of FIG. 1, according to an illustrative embodiment of the present invention. The winged submersible 100 includes a front communications transponder 202, a front control gauge housing 204, non-skid deck surfaces 206, front dome lifting handles 208, airbag covers (port/starboard) 210, a front hatch handle 212, forward lift rings (port/starboard) 214, a rear control gauge housing 216, wing ailerons (port/starboard) 218, rear hatch handles (port/starboard) 220, thrusters (port/starboard) 222, rear lift rings 224, elevators (port/starboard) 226, rudders 228, a rear airbag housing 230, and optional mounting areas 232 for lights/cameras.

It is to be appreciated that while two thrusters (port/starboard) are shown and described herein, other arrangements may also be employed while maintaining the spirit of the present invention. For example, a single center line thruster could be employed in place of the two thrusters, or a single center line thruster added for additional steerage. In the latter case, the center line thruster could be pivoted (e.g., with the rudder or independently of the rudder) or have a thrust deflector. Conventional propellers or any other type may be employed on the thrusters including, but not limited to, cycloid propellers. Moreover, oscillating fin type propulsion may also be employed.

It is to be further appreciated that while front and rear external control gauge housings are shown and described, other arrangements are possible, including maintaining all gauges and other instrumentation within the pods themselves. Moreover, electronic video displays can be used in place of, or in addition to, any gauges and similar instrumentation described herein.

Moreover, it is to be appreciated that any type of aircraft wing and arrangement may be employed on a winged submersible according to the present invention while maintaining the spirit of the present invention. Thus, the present invention is not limited to the main wings and elevators arrangement shown and described herein.

Figure 3:
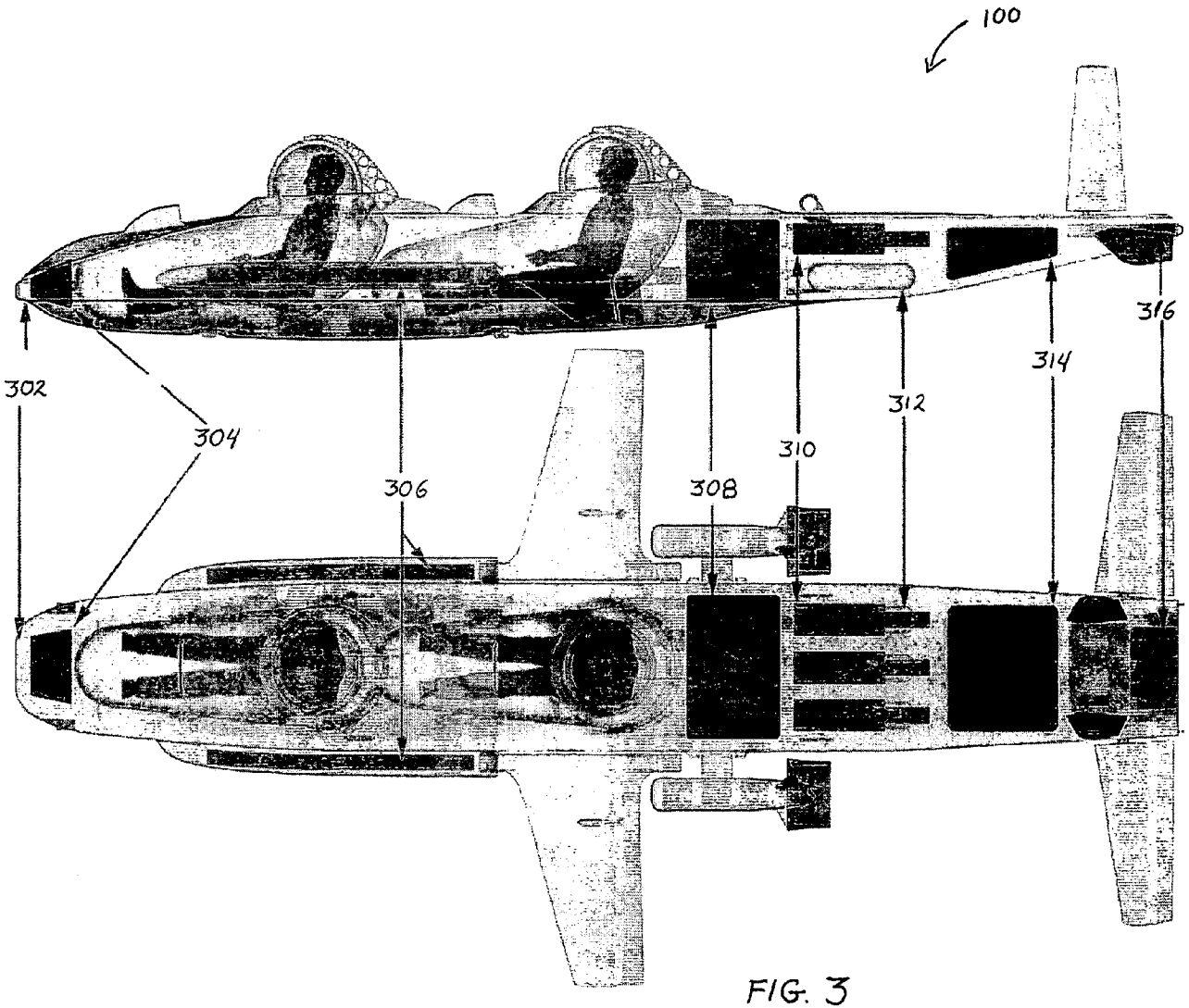
FIG. 3 is a diagram further illustrating internal details of the winged submersible 100 of FIG. 1, according to an illustrative embodiment of the present invention.

FIG. 3 is a diagram further illustrating internal details of the winged submersible 100 of FIG. 1, according to an illustrative embodiment of the present invention. The winged submersible 100 includes arc light emplacements 302, forward ballast 304, lateral airbags 306, batteries 308, electric bottles 310, High Pressure (HP) oxygen tanks 312, aft buoyancy 314, and an aft airbag 316.

A description will now be given of the internal controls of the winged submersible, according to an illustrative embodiment of the present invention. It is to be appreciated that the present invention is not limited to the internal controls shown and described herein. That is, given the teachings of the present invention provided herein, one of ordinary skill in the related art will contemplate these and various other configurations and implementations of the internal controls of the winged submersible, all while maintaining the spirit of the present invention.

The description of the internal controls of the illustrative embodiment will begin with a description of the pilot pods, as most controls are included therein.

Figure 4A:
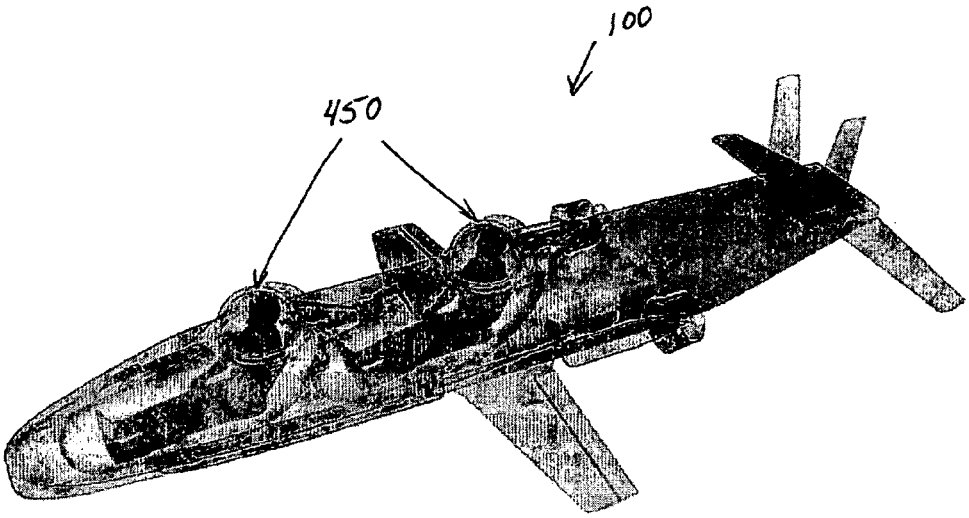
FIGS. 4A–B are diagrams illustrating the pilot pods 450 of the winged submersible 100 of FIG. 1, according to an illustrative embodiment of the present invention.
Figure 4B:
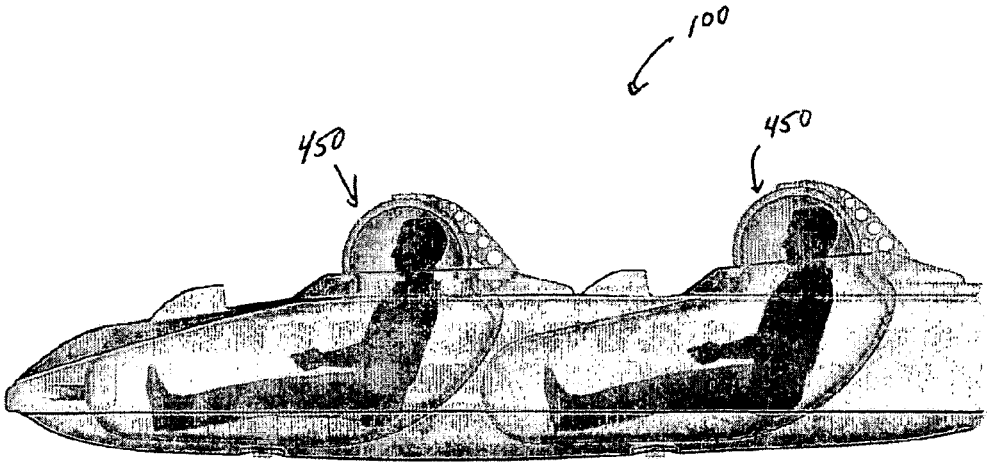

FIGS. 4A–B are diagrams illustrating the individually pressurized pilot pods 450 of the winged submersible 100 of FIG. 1, according to an illustrative embodiment of the present invention. Both forward and aft pilot (pressure hull) pods 450 are preferably but necessarily essentially identical, with full dual controls and instrumentation. The illustrative embodiment of the winged submersible can be piloted from either pod 450, although single-person operation of the submersible will usually be from the front pod. FIGS. 4–7 illustrate the locations of both pressure pods and pilots/crewmembers, and the general control arrangements inside the pods, according to various illustrative embodiments of the present invention.

A description will now be given of pod flight controls for a winged submersible, according to an illustrative embodiment of the present invention.

Figure 5:
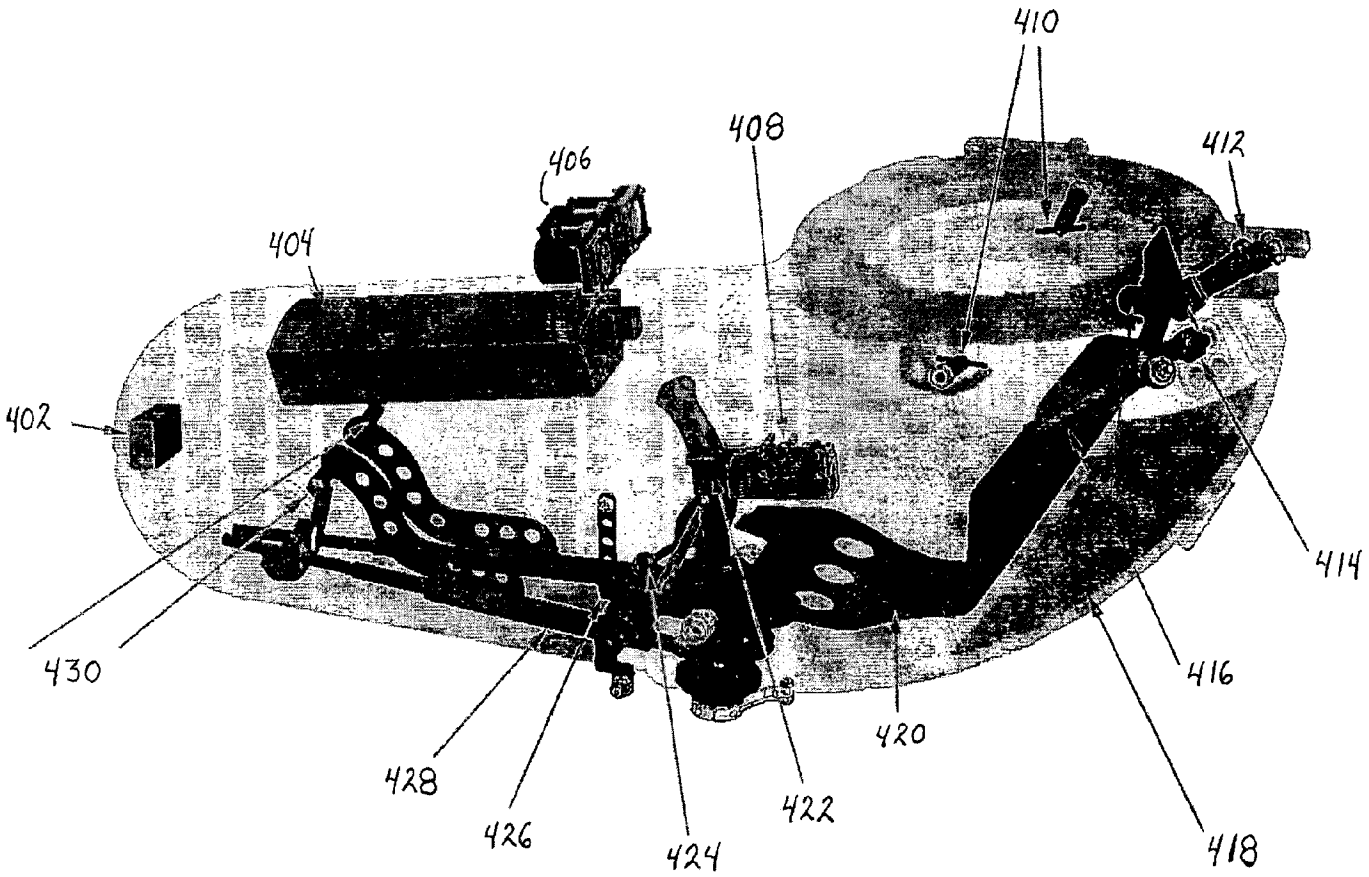
FIG. 5 is a diagram further illustrating the pilot pods 450 shown in FIGS. 4A–B, according to an illustrative embodiment of the present invention.

FIG. 5 is a diagram further illustrating the pilot pods 450 shown in FIGS. 4A–B, according to an illustrative embodiment of the present invention. As noted above, the pilot pods 450 include most of the pod flight controls. Each of the pilot pods 450 includes the following, unless otherwise noted: a compass sensor (forward pod only) 402, a CO2 scrubber 404, external instrument gauges (hull cover not shown) 406, an internal control console 408, emergency dome catch releases 410, an emergency gas bag inflation valve 412, an internal pressure equalization valve 414, oxygen regulators (port and starboard) 416, an electronics/cooling fan area (behind seat) 418, a seat plate (padding not shown) 420, a joystick 422, an emergency weight drop lever 424, a throttle lever 426, rudder pedal length adjustment 428, and rudder pedals 430.

It is to be appreciated that in some embodiments of the present invention, the rudders may be controlled by some other means other than rudder pedals 430, such as, for example, twisting the joystick 422 or by manipulation of a wheel or yoke that is mounted on the joystick 422. Moreover, control of the rudders may be implemented by a hydraulic or electric linkage, as opposed to the mechanical linkage provided by the rudder bars. In such a case, hydraulic and/or electromechanical actuators may be employed to control the positions of the rudders.

Figure 7:
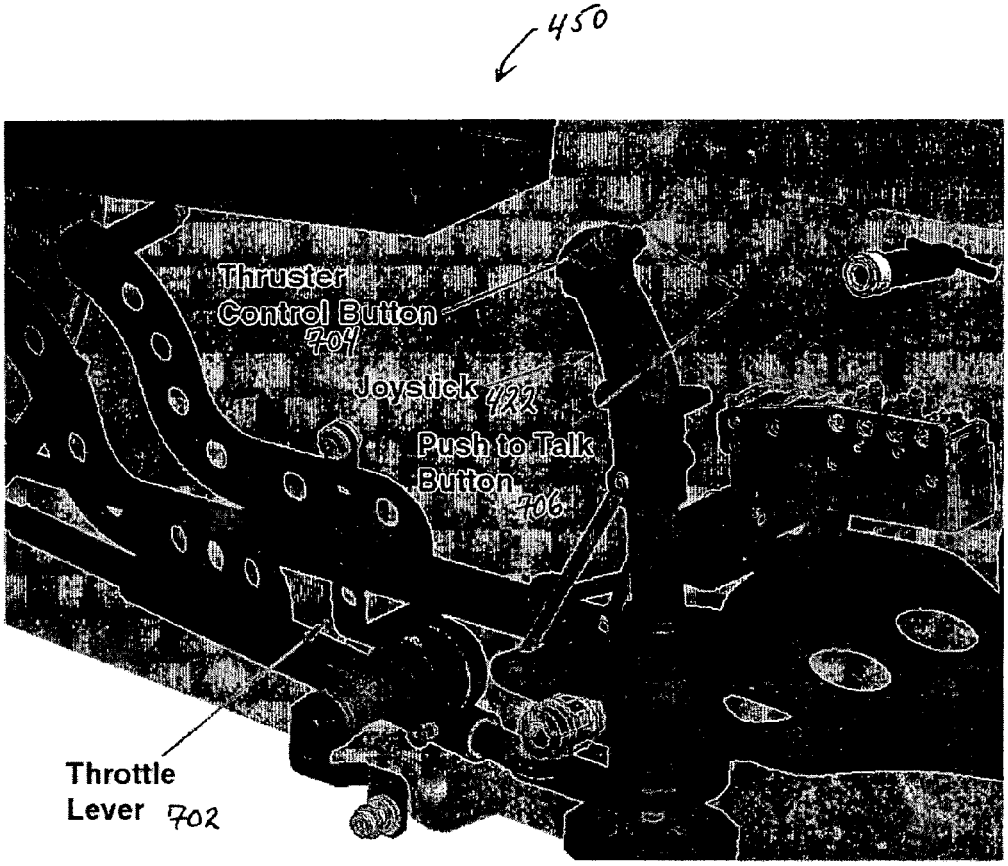
FIG. 7 is a diagram illustrating the throttle lever 426 and the joystick 422 shown in FIG. 5, according to an illustrative embodiment of the present invention.

It is to be further appreciated that many of the specifics regarding the selection of controls (e.g., the types of controls selected including, but not limited to, switches, buttons, levers, etc.), gauges, and other instrumentation and their locations are merely for illustrative purposes and, thus, other controls, gauges, and instrumentation for performing similar functions and other acceptable locations may also be employed in a winged submersible according to the present invention, all while maintaining the spirit of the present invention. For example, the thruster control button 704 described herein below with respect to FIG. 7 is shown mounted on the top center of the joystick 422. Of course, variations such as mounting the button 704 on the side of the joystick 422 or in some other location not on the joystick 422 but elsewhere within the pod, or by using a control other than a button, all are within the spirit of the present invention, given the teachings of the present invention provided herein.

Figure 6:
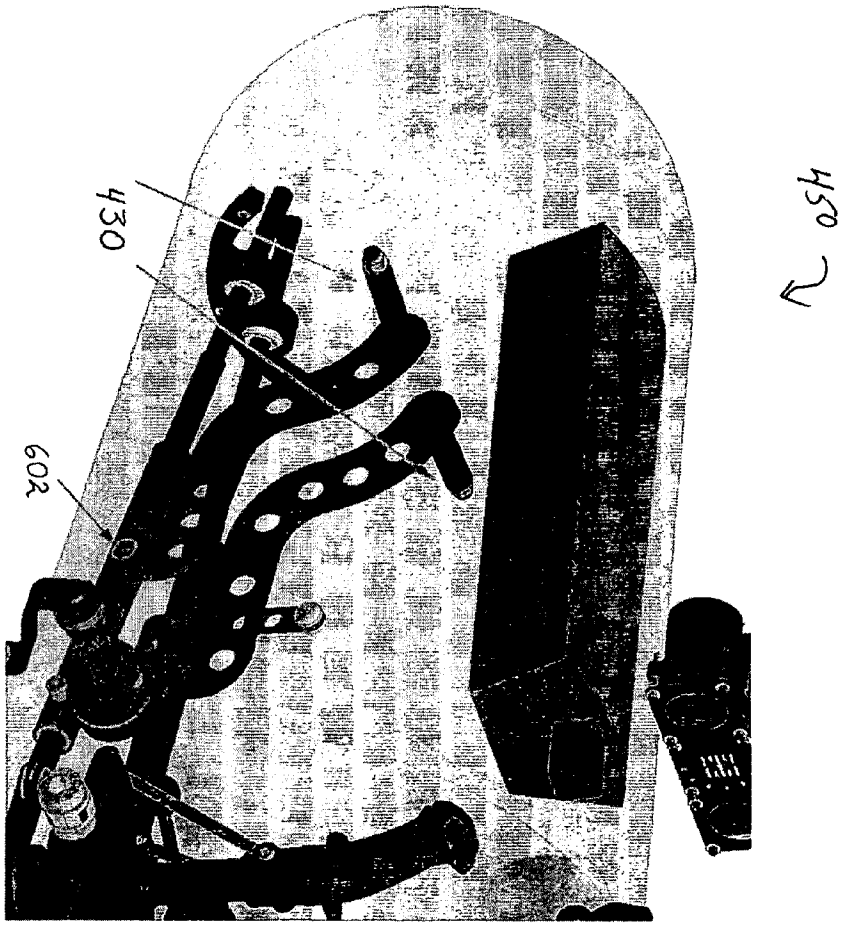
FIG. 6 is a diagram further illustrating the rudder pedals 430 shown in FIG. 5, according to an illustrative embodiment of the present invention.

FIG. 6 is a diagram further illustrating the rudder pedals 430 shown in FIG. 5, according to an illustrative embodiment of the present invention.

According to the illustrative embodiment, both pods 450 feature a conventionally styled (aircraft) foot rudder bar, mechanically linked between the twin pilot pods. The pilot's heels rest on the bottom of the hull, while the ball of their foot presses on the rudder bar itself. Pushing with the right foot and extending the right leg will initiate a rudder turn to starboard (to the right), as is the normal convention for aircraft.

It is to be noted that the position of the rudder pedals 430 is adjustable via the length adjustment pin 602, so the user should set this for comfort.

In the illustrative embodiment, the pod flight controls include a throttle lever 426. The throttle lever 426 is mounted low on the left side (by the diver's left thigh) and mechanically linked between the pods 450. The throttle lever 426 controls the thrust (that is, the current running to the motors) of both thrusters. Those of skill in the related art will appreciate that other configurations are possible. For example, separate throttle levers could be provided for each thruster, throttle controls other than levers could be used, the placement of the throttle controls could be varied, and the throttle lever may not be linked or may be linked by other means other than mechanical linkage.

In the illustrative embodiment, pulled back (near horizontal) on the throttle lever 426 against a mechanical stop, the thrust is set to zero. Pushing forward on the throttle lever 426 increases thrust, with a maximum thrust being achieved when the throttle lever 426 reaches another mechanical stop. The active range is 50 degrees. It is to be noted that the throttle lever 426 has a light friction hold, and maintains thrust as it is set in its last position.

FIG. 7 is a diagram illustrating the throttle lever 426 and the joystick 422 shown in FIG. 5, according to an illustrative embodiment of the present invention. The throttle lever 702 is disposed next to the pilot's left thigh. The internal control console is on the opposite side. The joystick 422 includes a thruster control button 704, and a push to talk button 706.

Both pods 450 feature the center-mounted joystick 422, similar to some modern fighter planes, linked mechanically between the two pods 450. There is direct linkage through low-friction pressure bulkheads and rigid links to manipulate fully the rear elevators 226 and the main wing ailerons 218.

A description will now be given of joystick control basics, according to an illustrative embodiment of the present invention. It is to be appreciated while the winged submersible employs the aircraft standard (e.g., push joystick forward to dive, etc.) with respect to joystick control, other standards (e.g., pull joystick back to dive, etc.) may also be employed while maintaining the spirit and scope of the present invention.

Figure 8A:
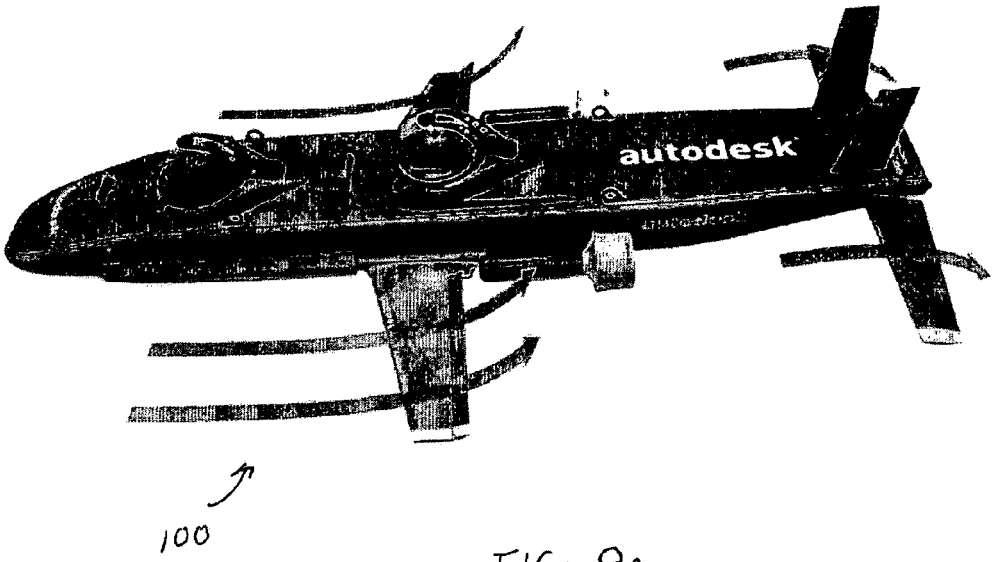
FIGS. 8A–B are diagrams illustrating water flow over the wings of the winged submersible 100 of FIG. 1 with respect to a pitch attitude adjustment, according to an illustrative embodiment of the present invention.
Figure 8B:
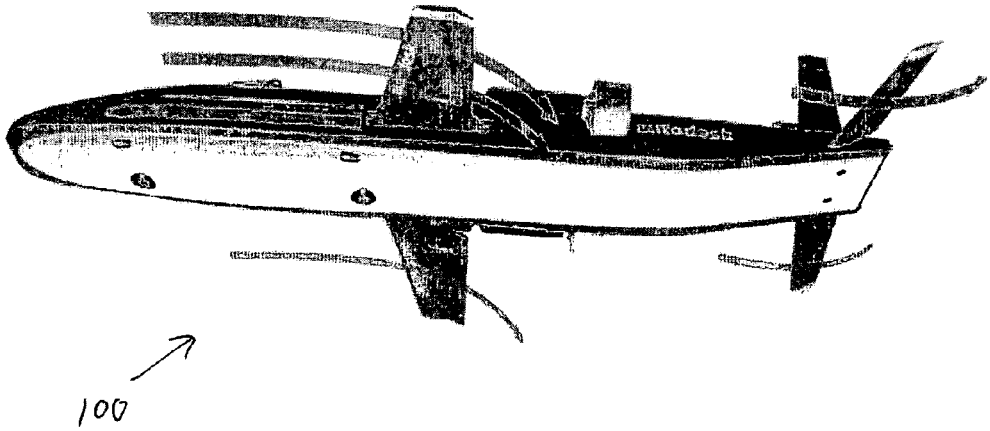

FIGS. 8A–B are diagrams illustrating water flow over the wings of the winged submersible 100 of FIG. 1 with respect to a pitch attitude adjustment, according to an illustrative embodiment of the present invention.

In the most preferred embodiment, regarding pitch, pushing forward makes the ailerons 218 rise. The main wings 218 develop negative lift, which draws the submersible 100 downwards, while the elevators 226 lift the tail and pitch the nose down into a dive. That is, pushing the joystick 422 forward adjusts the ailerons 218 and elevators 226 upwards, nosing the submersible 100 into a dive (wing and elevator arrows show the direction of water flow over those surfaces). Pulling back on the joystick 422 adjusts the ailerons 218 and elevators downwards, pitching the submersible 100 up into an ascent (wing and elevator arrows show the direction of water flow over those surfaces).

Figure 9:
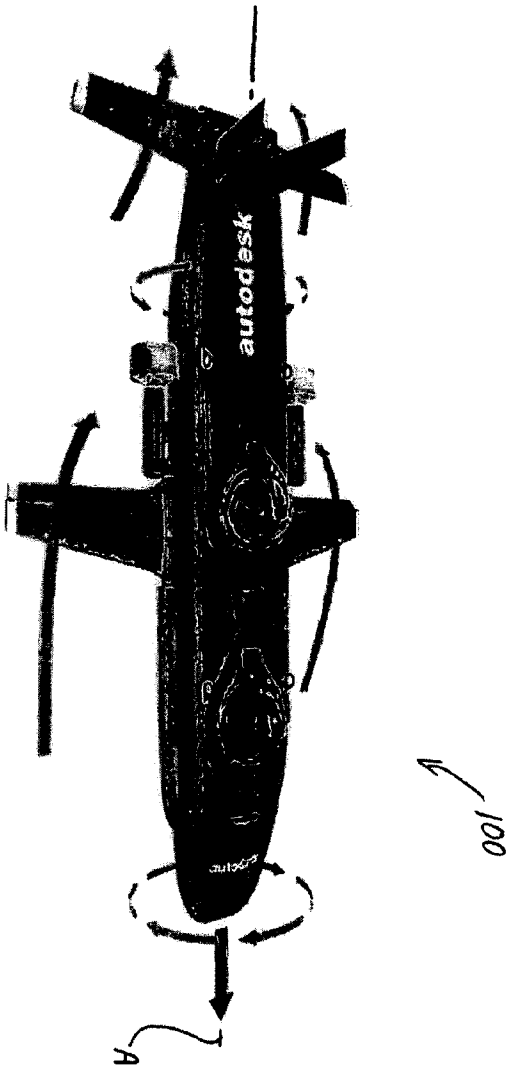
FIG. 9 is a diagram illustrating water flow over the wings of the winged submersible 100 of FIG. 1 with respect to a roll adjustment, according to an illustrative embodiment of the present invention.

FIG. 9 is a diagram illustrating water flow over the wings of the winged submersible 100 of FIG. 1 with respect to a roll adjustment, according to an illustrative embodiment of the present invention.

In the most preferred embodiment, regarding a roll maneuver, pushing the joystick 422 to the right results in the starboard wing 218 generating negative lift along with the starboard elevator 226, while port side control surfaces act together (to lift) so the submersible 100 rolls right (wing and elevator arrows show the direction of water flow over those surface). To roll the submersible 100 to the left, the joystick 422 is simply pushed to the left. It is to be noted that by combining a roll with a rudder turn and/or the joystick thruster controls (see herein below), the submersible 100 can be rolled into a shallow or steeply banked turn.

As shown in FIGS. 1*c* and 9, the submersible 100 is capable of rolling about its longitudinal axis A in varying degrees. By moving the starboard and port wings (ailerons) 218 into opposite directions with respect to each other, the submersible rolls about axis A. According to exemplary embodiments, the roll of the submersible can be in a range of 0–360 degrees in either starboard or port directions around axis A.

Figure 10:
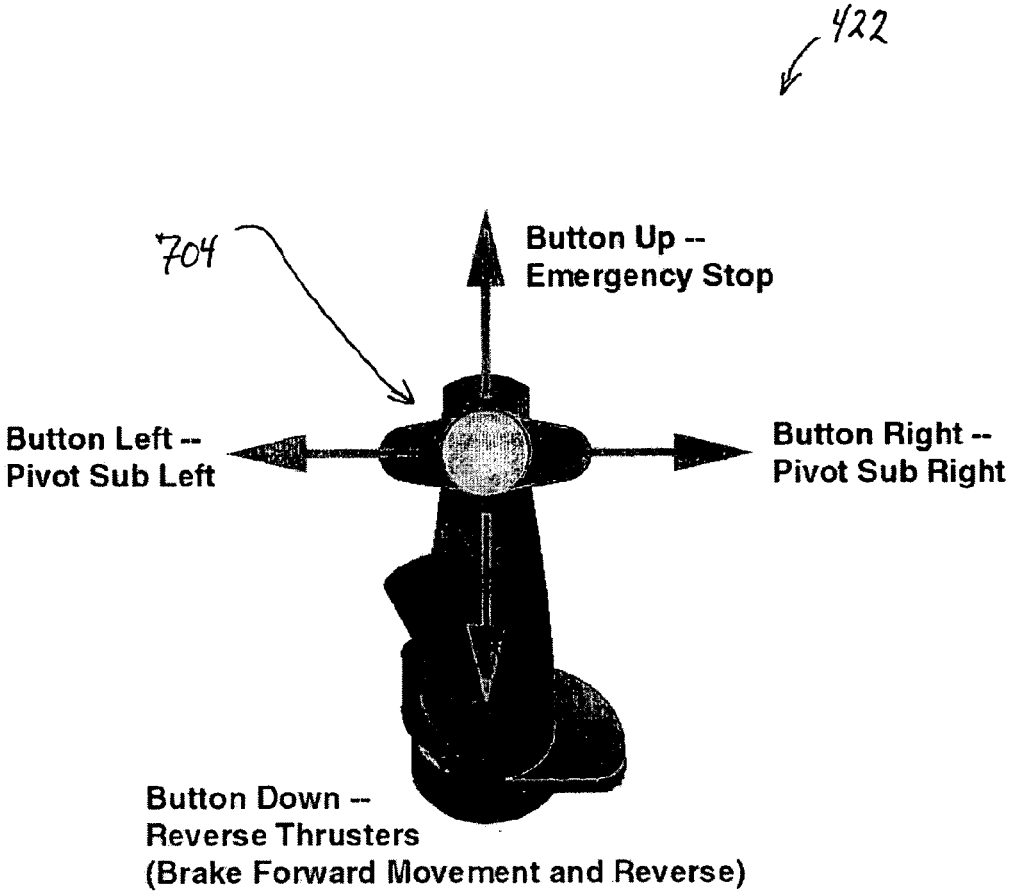
FIG. 10 is a diagram further illustrating the thruster control button 704 shown in FIG. 7, as well as corresponding submersible actions initiated by movement of the button 704, according to an illustrative embodiment of the present invention.

FIG. 10 is a diagram further illustrating the thruster control button 704 shown in FIG. 7, as well as corresponding submersible actions initiated by movement of the button 704, according to an illustrative embodiment of the present invention. The thruster control button 704, also referred to herein as a "joystick center/top hat thumb switch", is a "momentary action" switch, spring-loaded to return to the center OFF position. The thruster control button 704 vectors the sub's thrusters to assist in turning or braking the submersible. The thruster control button's 704 functions include thrust cutout, reverse thrusters, and thruster assisted turn.

Regarding thrust cutout, by pushing up on the thruster control button 704, both thruster shafts (propellers) slam to an emergency stop. This is used as a safety device to protect nearby divers (in practice, divers should not be too close to the submersible while it's in operation), or to stop a rope line or debris from being swallowed into a thruster.

Regarding reverse thrusters, pushing down on the thruster control button 704 results in a braking action, as this reverses both thrusters. Note that the motor controllers are programmed to ramp down somewhat slowly, then ramp up in reverse to about 60 percent of the throttle setting, taking about 5 seconds to cycle into reverse. For an emergency stop, the pilot should use the thruster control button 704, but may also ram the throttle lever 426 to maximum power. It is to be noted that the throttle lever 426 is to be pulled back down to zero before releasing reverse—otherwise, the submersible will leap forward when the thruster control button 704 is released, and full forward thrust is immediately resumed.

Regarding a thruster assisted turn, pushing right or left on the thruster control button 704 reverses one thruster (port or starboard) to aid a turn. Since there is no flight convention for this, H.O.T. followed what is customary with remotely operated vehicle (ROV) control. Pushing the thruster control button 704 to the right results in the right side thruster reversing, inducing a turn to starboard (right). Pushing the thruster control button 704 to the left results in the winged submersible rotating to port (left). Note that, when operating in reverse, the propellers have reduced efficiency and give only 60 percent reverse thrust, so the effect is not to yaw about the sub's center, but to reduce overall speed (or move ahead from a stop) and initiate a gentle turn. It is to be noted that a minimum turning circle can be initiated by coordinated use of rudders, thrust and joystick, with the submersible heavily banked into the turn.

Also mounted on the joystick in the illustrative embodiment is the push-to-talk button 706. The push-to-talk button 706 is on "thumb right". Additional buttons are wired for future expansion but not in use at the moment.

In contrast with most conventional submersibles, the winged submersible of the present invention is designed to "fly" under water. Most conventional submersibles have a natural stability that keeps the submersible upright and makes rolling the submersible difficult or impossible. This natural stability is provided, at least in part, by having the center of bouyancy of the submersible separated from the center of gravity. Indeed, ABS standards specify that the center of bouyancy be a minimum distance of two inches from the center of gravity. The stability in most conventional submersibles is further provided by having control surfaces that generate small forces relative to the natural stability of the submersible. The winged submersible is able to "fly" by providing control surfaces (for example, the wings, ailerons, elevators, and rudders) that generate large forces relative to the natural stability of the submersible.

Figure 11:
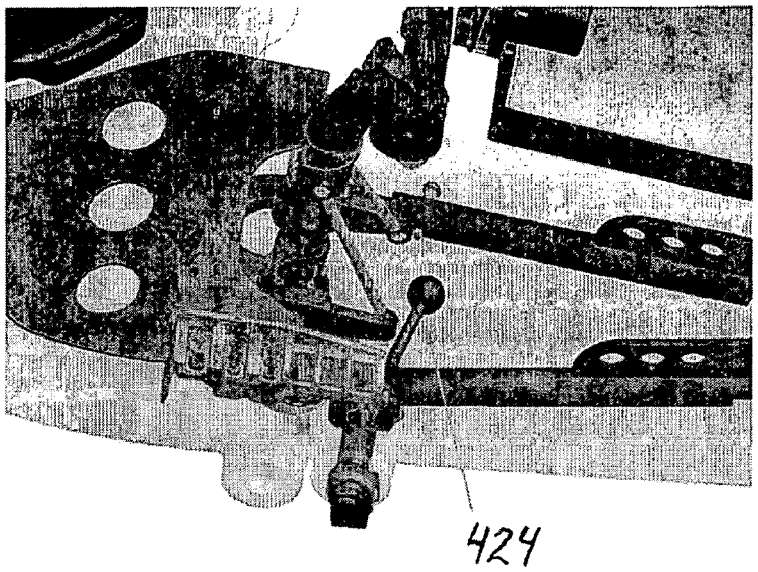
FIG. 11 is a diagram further illustrating the emergency weight drop lever 424 shown in FIG. 5, according to an illustrative embodiment of the present invention.

In the preferred embodiment of the winged submersible, the center of bouyancy of the submersible is as close as possible to the center of gravity of the submersible. In a most preferred embodiment, the center of gravity is less than two inches from the center of bouyancy of the submersible. It is to be appreciated that the distance between the center of bouyancy and center of gravity can vary consistent with the present invention, and can substantially exceed two inches, provided that the control surfaces of the submersible are designed to generate forces large relative to the natural stability of the submersible, in order to achieve the desired maneuverability of the submersible FIG. 11 is a diagram further illustrating the emergency weight drop lever 424 shown in FIG. 5, according to an illustrative embodiment of the present invention. The emergency weight drop lever 424 (preferably implemented in red) folds (stows) flat across the belly (athwart ships) of the pod 450 in front of the joystick 422. To operate the emergency weight drop lever 424, the emergency weight drop lever 424 is first rotated from its stowed position to upright, which also unlocks the mechanism. The lever 424 is pulled towards the operator, rotating 30 degrees. This is intended for emergency weight release to be used if the submersible is operated in a neutrally buoyant (not positively buoyant) configuration. It is to be noted that this feature is optional, and that the winged submersible is typically operated in a positive buoyancy configuration.

Each cockpit seat preferably is equipped with a 5-point harness, similar to those won by racecar drivers. The individual seat and shoulder belts can fasten into a central circular buckle, worn in the middle of each pilot's chest. A quarter-turn on the buckle's release knob will release the belts immediately for surface exit. Of course, other arrangements may be used to secure each individual within each pod including, but not limited to, three point harnesses, lap belts, and so forth.

Figure 12:
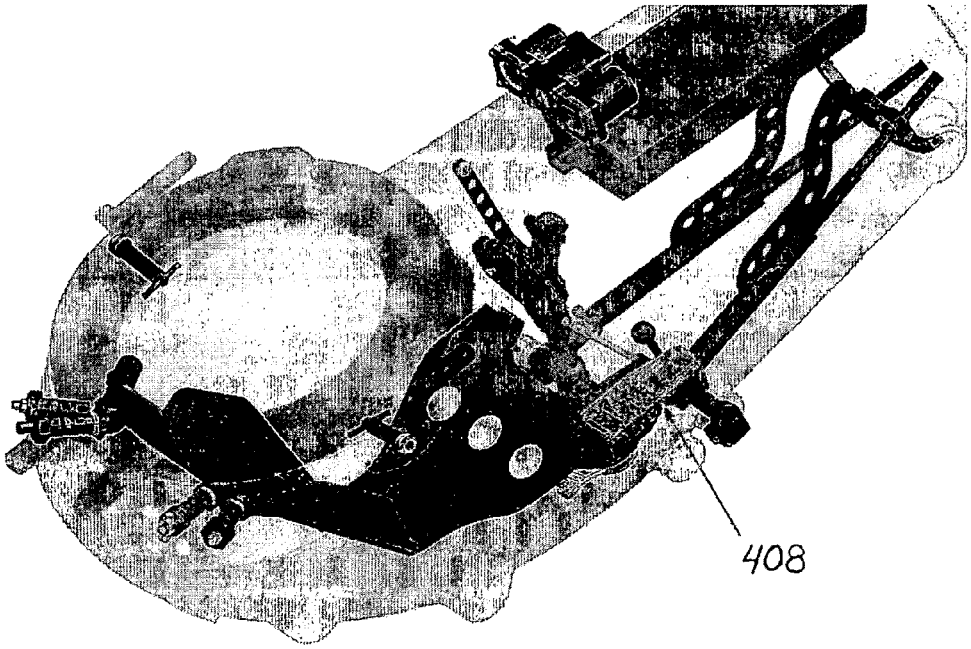
FIGS. 12 and 13 are diagrams further illustrating the instrument control console 408 shown in FIG. 5, according to an illustrative embodiment of the present invention.
Figure 13:
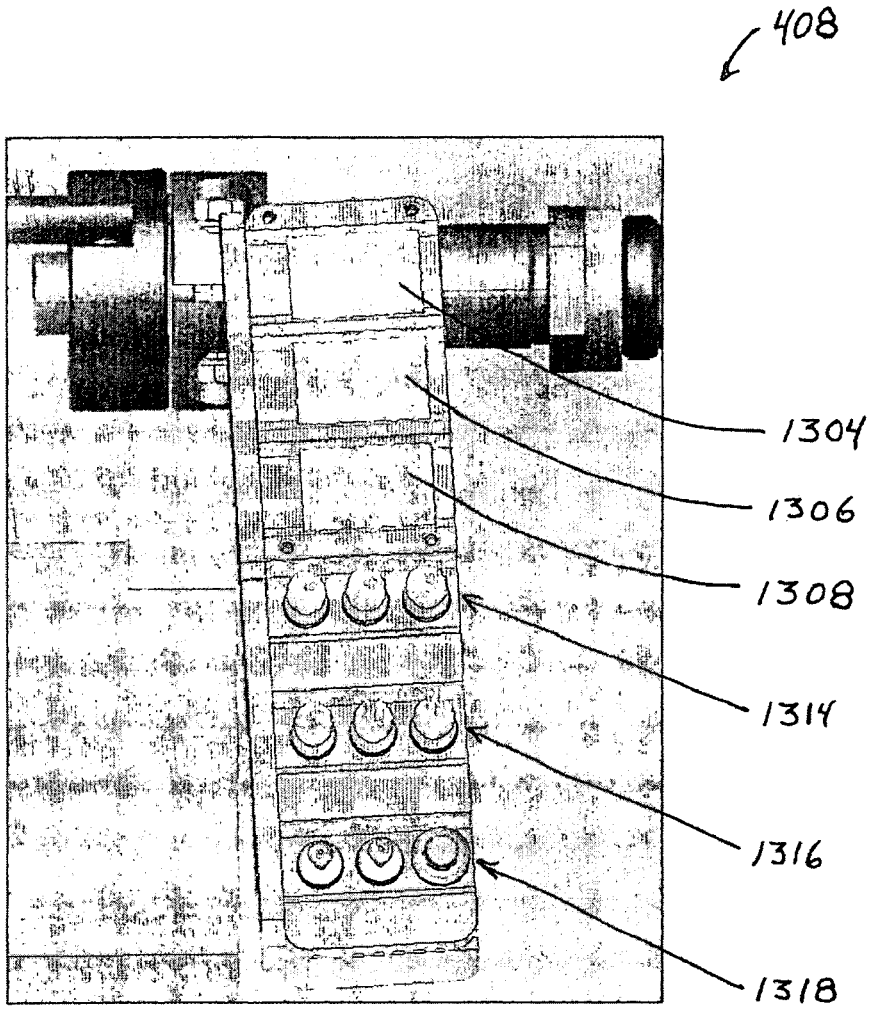

A description will now be given of an internal instrument console of the winged submersible, according to an illustrative embodiment of the present invention. The internal instrument console is a small rectangular console set low and to the pilot's side by their right thigh, as shown in FIG. 12. FIGS. 12 and 13 are diagrams further illustrating the instrument control console 408 shown in FIG. 5, according to an illustrative embodiment of the present invention.

The console 408 includes three digital displays (1304, 1306, and 1308) and three banks (1314, 1316, and 1318) of three switches. The three displays respectively correspond to thrust setting, an oxygen sensor, and battery condition.

Regarding the top digital display 1304 corresponding to thrust setting, this display is read from the yellow digital gauge, which is incremented by percentage, and scaled so that maximum continuous thrust reads 100 percent. Pushing the throttle all the way forward to mechanical stop will reach thrust (depending on battery charge) up to 130 percent. Normal cruise (navigation) is at about 20–40 percent to conserve battery life.

Regarding the middle digital display 1306 corresponding to the oxygen sensor, this display is used to display cabin oxygen content. Note that this is currently set to read 21 when O2 levels are (normal) or the same ideal mixture as air (actual O2 will have a partial pressure of 0.21 bar, or 21 percent). It is to be noted that the low level limit (dive abort) is 17 but a diver should take action to keep above a 19 percent reading on the "Green" gauge. It is to be further noted that a high O2 limit (dive abort) is a 28 reading but a diver should take action to keep under a reading of 24 on the "Green" gauge.

Regarding the lower digital display 1308 corresponding to battery condition, this display is used to display battery voltage. This is scaled to read 100 percent with a fresh battery charge. Low dive limit is 80 percent; battery damage can start at 75 percent.

A description will now be given of the toggle switches corresponding to the instrument console, according to an illustrative embodiment of the present invention.

There are nine (9) switches on the console, arranged in three rows (or banks) of three. The top row (locking toggle switches, with OFF away from the operator) 1314 powers up the submersible and are all ON (locked back towards the operator) in normal operation. The second row 1316 powers up optional circuits such as instrumentation and sonar. The third row 1318 is generally set for personal comfort.

To power up the winged submersible, the pilot (user) switches the top row 13040N (pulling back towards you) in sequence, moving left to right. To power down the winged submersible, the order is reversed: Push the top row of switches 1304 forward to the OFF positions, moving Right to Left. It is to be noted that the entire switch group needs to be ON in both pods for the submersible to function properly.

Life support and control power are represented by the (first) top left toggle, which is marked "P". "P" switches 12 V service power to the primary control buss. Note that each pod has a separate (redundant) 12 V source. The forward pod powers up from the port electric bottle (EB). The aft pod powers up from the starboard EB. The submersible powers up (i.e., the pods) when either pod "P" is switched ON. However, in normal operation, both pods have "P" ON for redundancy.

Main contactors are represented by the top middle toggle, which is marked "CON". This pulls in the main power contactors to the thruster controllers and auxiliary power circuits. In this case, the two CONs on in each pod are in series and both must be ON to power up thrusters, main lights and 24 V service in the pods. The requirement for both pods to enable CON is a safety precaution so that either pilot can shut down all power (other than for life support).

Ignition is represented by the top right toggle, which is marked "IGN". This is the final "ignition" switch for thruster operation. In submersibles this is usually called "Thruster Enable." The two IGN switches in the two pods, like CON, are wired in series, so both need to be ON for the submersible to function properly. Again, this is so either pilot can disable thrusters. It is to be noted that IGN is routinely switched OFF to disable thrusters for launch and recovery when a diver's hands/fingers may be at risk. In addition, thruster amplifiers will not enable (IGN=ON) unless or until the throttle is at zero.

Auxiliary power (fwd & aft) is represented by the middle row, left toggle, which is marked "PP". Each pod "PP" switches a separate high-power circuit OFF or ON. These will be most commonly used for high-powered lights (currently not fitted.) For example, the aft pod PP may switch wingtip lights, while the forward pod PP may switch nose-mounted floodlights. It is to be noted that the preceding, as well as the following C1 and C2, are different circuits in each pod and will power up different systems, so that between the two crewmembers, these three switches control six separate circuits. Hence PP, Cl, and C2 are also differentiated by fwd or aft.

Circuit 1 (fwd & aft) is represented by the middle row, middle toggle, which is marked "C1". Cl is a 24 V circuit that on the front pod powers the compass and heading repeaters, altimeter and depth sensors, and therefore is ON for operation. It is to be noted that in the aft pod C1 is not currently in use, but is slated to power camera systems for future missions.

Circuit 2 (fwd & aft) is represented by the middle row, right toggle, which is marked "C2". C2 is currently a spare circuit not in use in either pod.

A cooling fan is represented by the bottom row, left toggle, which is marked "FAN". This is a center OFF momentary switch that can be momentarily toggled UP to increase cooling fan speed or DOWN to decrease cooling fan speed. The fan speed remains (remembers) where it is last set. It is to be noted that this cooling circuit blows air over the back of the pilot's neck and can be set for personal preference or to help keep the acrylic dome clear of condensation.

Also, although not provided in the illustrative embodiment, the winged submersible may be fitted with internal heating elements in the pods.

A dimmer is represented by the bottom row, middle toggle, which is marked "DIM". This functions as does the FAN switch, above, to set internal and lighting levels.

Oxygen is represented by the bottom row, right push button, which is marked "O2".

A description will now be given of gas system valves for life support, according to an illustrative embodiment of the present invention.

Figure 14:
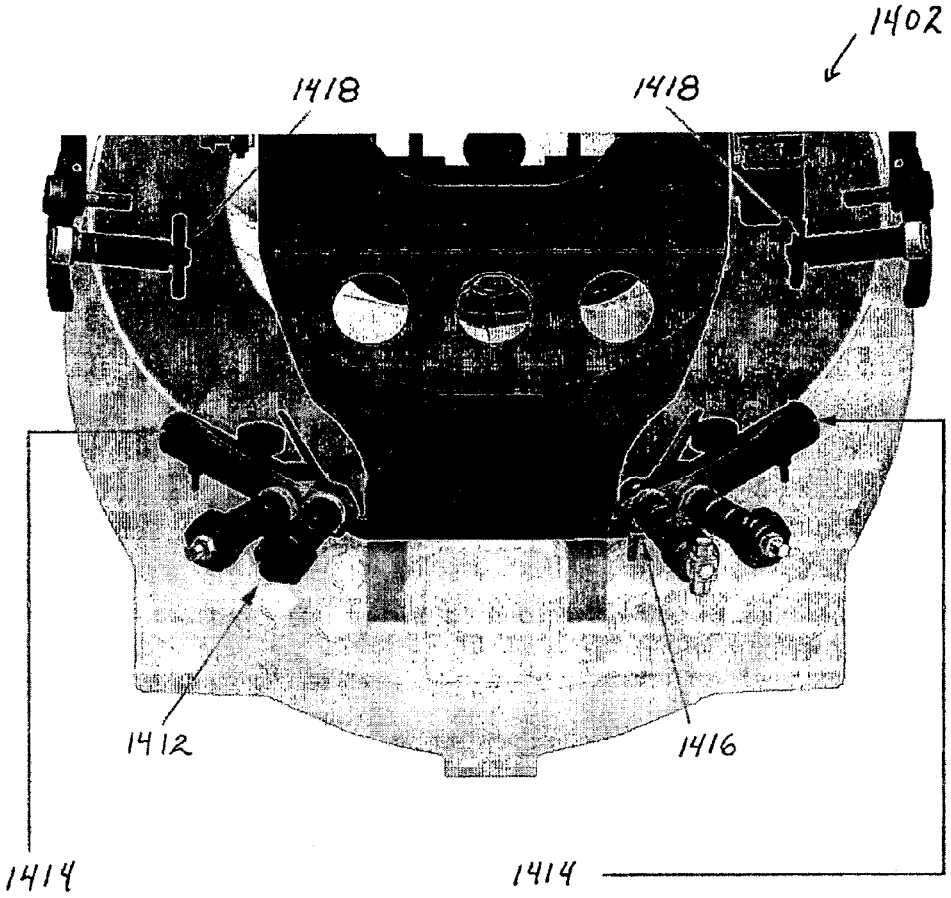
FIG. 14 is a diagram illustrating life support user interfaces 1402 for a winged submersible, according to an illustrative embodiment of the present invention.

FIG. 14 is a diagram illustrating life support user interfaces 1402 for a winged submersible, according to an illustrative embodiment of the present invention. The life support user interfaces include a pressure equalization valve 1412, oxygen regulators (port and starboard) 1414, an emergency gas bag inflation switch 1416, and emergency dome catch releases 1418. The gas system valves are positioned high on the pilot's back, near their shoulders.

Regarding the oxygen regulators 1414, two port and starboard (redundant) oxygen systems are fitted to hull breakthroughs on either side of the pilot's shoulders. The port side regulators in the forward and aft pods are both connected to the port side, 80-cubic-foot high-pressure bottle in the rear of the submersible. Similarly, both starboard side regulators are supplied from the starboard-side oxygen bottle.

The illustrative embodiment of the winged submersible has ample oxygen stores with about 20 man-hours supply per 1000 psi of stored pressure, per side. The regulators are custom to the winged submersible, and are completely self-contained and extremely compact, eliminating extraneous piping.

The first stage of the system is a High Pressure (HP) Shut-Off valve. This valve should never be forced; it needs only a one-quarter (¼) turn for ON.

When the HP valve is ON, the system store pressure can be read directly from a barrel gauge cut into the body of the regulator. The oxygen flow into the pod is set by the large dial at the end of the unit; its engraved dial shows the actual oxygen flow rate. The flow dial has click stops to preset levels, from 0 to 1.5 liters per minute at 0.1 l/m intervals. The flow rate can be adjusted at intervals to match the pilot's actual average oxygen consumption, which will be in the range of 0.3 to 0.7 liters/min.

A good start point to set O2 flow is 0.5 l/m. From there, the oxygen flow is simply increased if the oxygen readout (or cabin pressure) falls below nominal, or decrease the oxygen flow if the winged submersible "Green" reading increases more than 105 percent. As an example, about 0.4 l/m is used if relaxed and 0.6 l/m is used if maneuvering. It is sufficient to check PPO2 every fifteen minutes (the surface crew tracking the winged submersible will typically request a reading every 15–20 minutes). Bear in mind that unlike a diving re-breather, the winged submersible pods have a very large dilution volume—approximately 10 cubic feet—so gas mixtures change slowly, giving an operator plenty of time to react.

Regarding emergency gas flotation bag actuation, the actuation value 1416 for HP air to automatically inflate and deploy the emergency surface flotation system is behind the diver's right shoulder. This is a lever valve, rotated upwards one-quarter (¼) turn. Either pilot in either pod can actuate the system. To inflate the gas bag system, open the valve 1416 for a count of 20 seconds, then shut the valve 1416 off. Excess air is vented automatically once the bag pressure reaches three (3) pounds per square inch.

It is to be noted that the HP air supply is sized to inflate the system exactly, so once actuated the valve the valve 1416 can be left open. In addition, the store pressure is checked by the surface crew as part of pre-dive and is not monitored by the winged submersible pilots.

Regarding the pressure equalization valve 1412, behind the pilot's left shoulder is a push-button plunger that will equalize pressure inside the pod to the outside. This is only used at the end of the dive to equalize any small pressure differential that may arise during the dive. The pressure equalization valve 1412 will also automatically relieve any positive pressure in excess of 0.5 psi.

It is to be appreciated that the present invention is not limited solely to the oxygen system described herein. For example, oxygen can be automatically controlled by mechanical bellows and a tilt valve to maintain a constant cabin pressure. Alternative, sensors that measure the oxygen content can control solenoid valves to keep the oxygen content at a pre-determined level.

Figure 15:
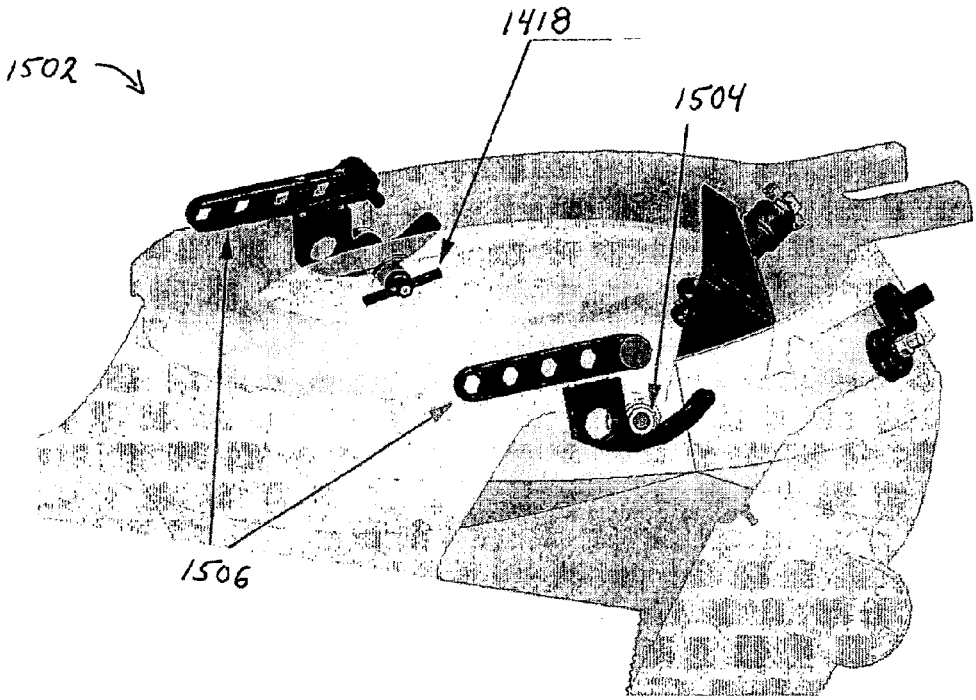
FIG. 15 is a diagram illustrating dome releases 1502 corresponding to pilot pods of a winged submersible, according to an illustrative embodiment of the present invention.

FIG. 15 is a diagram illustrating dome releases 1502 corresponding to pilot pods of a winged submersible, according to an illustrative embodiment of the present invention. The dome releases 1502 include the emergency dome catch releases 1418 shown in FIG. 14, as well as a dome release (port side, exterior bushing) 1504, and external dome latches (port and starboard) 1506.

Regarding the emergency dome catch releases 1418, the acrylic domes are normally closed and opened by outside assistance and cannot be locked closed by the pilot or crew from inside. However, in the event of an emergency requiring one or both crewmembers to exit the submersible (with surface buoyancy bags deployed), the emergency dome catch releases 1418 can be retracted by turning them counter-clockwise until the pin disengages. The dome can then be opened and the pilot(s) can exit the pod. The inner dome catch release levers enable the submersible crew to free the external dome latches 1506 and open the dome from within during an emergency.

It is to be noted that the topside launch crew can see the position of the external dome latches 1506, and should verify that they are shut before diving. In addition, the domes are weight-compensated so crewmembers can open them easily from within the pods without external assistance if necessary.

A description will now be given of external gauges and navigation corresponding to the winged submersible, according to an illustrative embodiment of the present invention.

Figure 16:
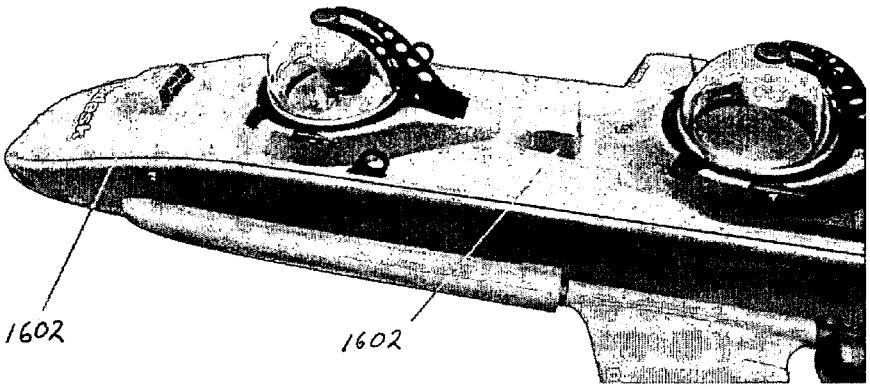
FIG. 16 is a diagram illustrating external navigational instrument housings 1602 for a winged submersible, according to an illustrative embodiment of the present invention.
Figure 17:
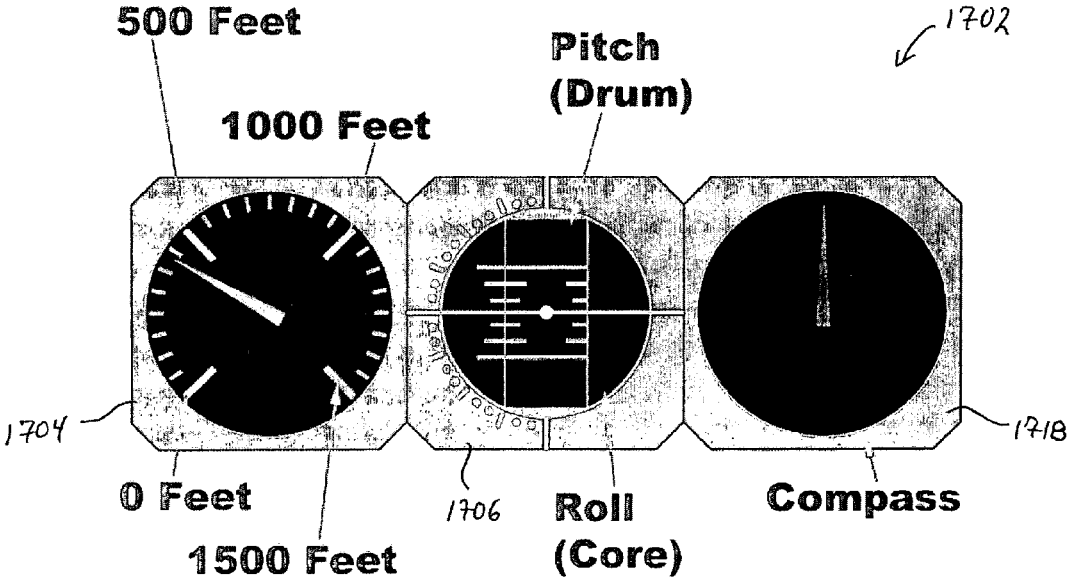
FIG. 17 is a diagram illustrating three external gauges 1702 included in the external navigational instrument housings 1602 shown in FIG. 16, according to an illustrative embodiment of the present invention.

FIG. 16 is a diagram illustrating external navigational instrument housings 1602 for a winged submersible, according to an illustrative embodiment of the present invention. FIG. 17 is a diagram illustrating three external gauges 1702 included in the external navigational instrument housings 1602 shown in FIG. 16, according to an illustrative embodiment of the present invention.

Outside of each winged submersible cockpit, directly in front of each pilot's face, is the navigational instrument cluster, similar to an external "dashboard". This includes the three external gauges 1702 disposed in a row for indicating depth, attitude and compass bearing, and covered by a cowling to reduce drag. Since the gauges are only a few feet in front of each pilot's face, they are easy to read, and preferably will be illuminated for deep dive and nighttime operations.

Both cockpits have identical instruments, with the emphasis on basic navigational information. The three external gauges 1702 shown in FIG. 17 from left to right are as follows: a depth gauge 1704, an artificial horizon (attitude, or pitch/roll) gauge 1706, and a compass heading gauge 1708.

The depth gauge 1704 indicates current depth. The depth gauge 1704 is a simple pressure gauge indicating the ambient pressure in pounds per square inch (psi), to 665-plus psi, or the winged submersible's maximum operational depth of 1,500 feet.

Although the actual psi readings may be hard to see, the face of the instrument has four large engraved marks. The first three are white indicating 0 (surface), 500 feet depth, 1000 foot depth and a larger red line indicating the maximum operating depth of 1,500 feet. Note that if the submersible operates in deep freshwater lakes, it will show the same pressure rating, but the depth will actually be a few percent deeper than indicated.

The artificial horizon (attitude, or pitch/roll) gauge 1706 is an artificial horizon instrument indicating pitch and roll with 5 degree graduations through a full 360 degrees in both axes. The artificial horizon (attitude, or pitch/roll) gauge 1706 is a simple gravity-referenced instrument unique to the winged submersible; as far as we know it is the only such submersible instrument rated to full ocean depth, since it's free-flooding. The rationale behind a simple "wet" instrument is that it remains working without power and remains operational even with the submersible powered down in "stealth" mode.

Pitch is indicated by the central drum, while roll is indicated by the rotating core. The instrument works so that the horizon line inscribed on the drum and core is the true horizon. Hence straight and level condition is intuitively indicated by the horizon lines aligning and forming an unbroken horizontal line (artificial horizon.) The central drum horizon line indicates the horizon line corrected in pitch, while the outer rotating core indicates the true horizon corrected for roll.

Note that if the submersible is inverted, either by pitch or roll past 90 degrees, inverted operation is indicated by part or all of the display line shown in red.

Regarding the compass heading gauge 1708, the gauge at the far right of the instrument cluster is the compass repeater. Housed in the foot well of the forward pressure pod is a magnetic sensor that drives both repeaters. This is a conventional vertical compass card. Note the sensor is gimbaled and works up to plus or minus 45 degrees in pitch and roll, but locks up if either pitch or roll exceeds 45 degrees.

Regarding Global Positioning System (GPS), GPS will only work while on the surface. Its use is therefore limited, but a small hand-held unit inside the cockpit should give an accurate surface fix to one or both pilots. Of course any configuration of controls is within the scope of this invention, including having any combination of controls or no controls external to the hull.

A description will now be given of life supports systems of the winged submersible, according to an illustrative embodiment of the present invention. It is to be appreciated that the present invention is not solely limited to the life support systems shown and described herein. That is, given the teachings of the present invention provided herein, one of ordinary skill in the related art will contemplate these and various other configurations and implementations of the life support systems of the winged submersible, all while maintaining the spirit of the present invention.

Figure 18:
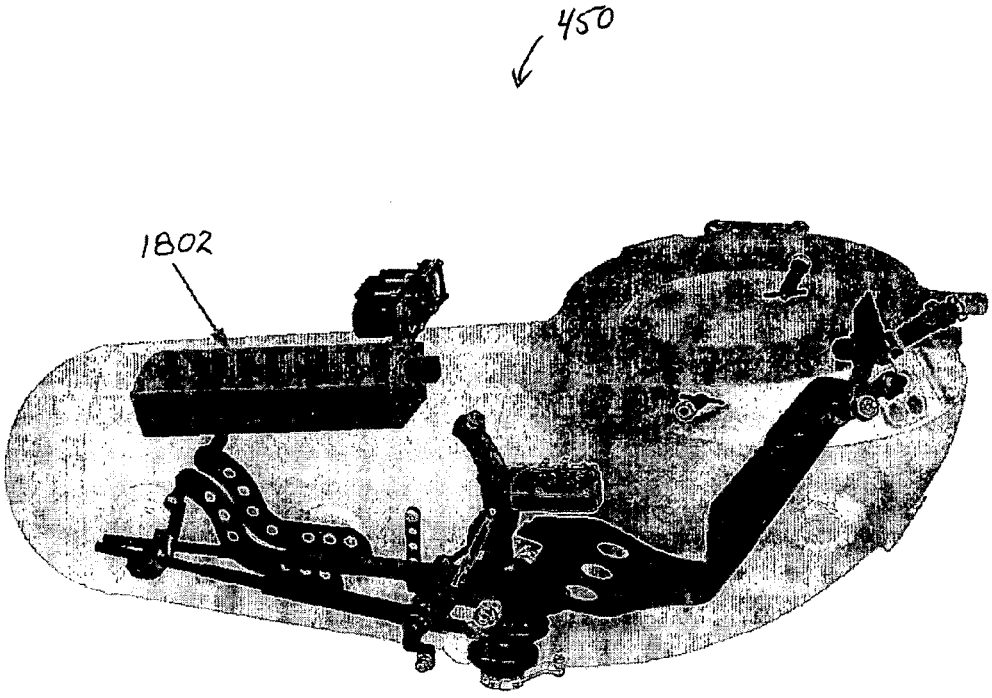
FIG. 18 is a diagram illustrating a CO2 scrubber 1802 within a pilot pod 450 of a winged submersible, according to an illustrative embodiment of the present invention.

Carbon dioxide and the CO2 scrubber will first be described. FIG. 18 is a diagram illustrating a CO2 scrubber 1802 within a pilot pod 450 of a winged submersible, according to an illustrative embodiment of the present invention. Before each dive, the winged submersible launch crew preps each scrubber, then slides it into racks mounted on the inner-top surface of the pods, above each pilot's knees. Submersible/diving regulations limit CO2 present in inhaled gas to less than 0.5 percent. Hence the scrubber system in the winged submersible pods is designed to keep CO2 levels under 0.5 percent.

The scrubber technology used for the winged submersible is simple and time-tested. The scrubber technology includes a high capacity fan circulating air through a chemical bed. The scrubber uses 24 pounds of SODASORB™ that passively absorbs the CO2(converts and locks the waste gas into a solid.) There are no adjustments, or even switches. This part of the LSS is fully automatic; the only check requires that the pilot ensure proper operation of the fans (two are running for redundancy) and unrestricted airflow.

More important, the physiological danger limits are very much higher than the regulation limit of 0.5 percent. The toxic level for CO2 is sometimes given as a threshold of four (4) percent.

One inherent safety feature of the winged submersible is that air in the winged submersible cockpit, or pressure pod of the present invention, has (by human standards) a massive dilution reservoir so that air gas mixtures in the pod can only change slowly, providing 30 minutes or more of breathable air even following an LSS system failure. In addition, the redundant oxygen systems and the ability to switch to a lung-powered scrubber provide appropriate redundancy to protect against any LSS failure.

A description will now be given of breathing mixture and cabin pressure relating to the winged submersible, according to an illustrative embodiment of the present invention. The description will initially include a brief overview of the "breathing mixture".

The way the atmospheric gas laws work is simple. One atmosphere (1 bar) has a partial pressure of oxygen at 0.21 bar, or 21 percent plus partial pressure of nitrogen at 0.78 bar, or 78 percent plus other inert gases at 0.01 bar, or 1 percent, which sum to a total of 1 bar or 100 percent. The winged submersible instrumentation works in millibar (mb) increments, but at one atmosphere it can be thought of in terms of bar, or percentage; the digits and changes are the same. It is to be noted that a millibar (or mb) is a unit of measure for air pressure. 1 millibar=us 0.02953 inches of mercury (Hg). Average sea level pressure is 1013.2 millibars, or 29.92 inches of mercury. The preceding definition of "millibar" is provided from http://www.uwsp.edu/qeo/faculty/ritter/glossary/l_n/millibar.html.)

According to an illustrative embodiment, the standard oxygen reading on the winged submersible's O2 instrumentation topside, prior to the dive, will be set to read 21 on the green display. This is adjusted by a pre-set potentiometer under a sealed cover behind the right shoulder of the operator. Increase in oxygen pressure as measured by this sensor would increase the reading to 22 and on up. Similarly, a decrease will drop the reading to below 21. Note that the winged submersible partial pressure oxygen (PPO2) instrumentation may not be linear; the key is to maintain a PPO2 reading close to the reference point of 21.

The cabin pressure (CP) or barometer pressure preferably will be indicated on two instruments. The primary instrument is a battery-operated altimeter set to display barometric pressure in millibar. This is an accurate instrument that will respond also to weather and true barometric pressure. Hence, the reference pressure used and maintained through the dive is simply the indicated barometric pressure in millibar.

Second, oxygen flow can be regulated (managed) either from the oxygen sensor to maintain a reading of 21, or by maintaining a cabin pressure constant once air temperature has settled when into a dive. The cabin pressure (or barometric pressure reading) is more sensitive, quicker to respond and has proven more reliable than the oxygen sensor. Hence, the flow is adjusted to maintain a constant barometric pressure and use the oxygen sensor reading as a back-up and reference only.

In addition, CP does vary (according to gas laws) by temperature. Upon first diving, the cockpit temperature will cool slowly, so the CP will drop somewhat. By maintaining CP at the initial reading with oxygen the "error" will slightly enrich the O2 level, which is acceptable.

A description will now be given of the oxygen system of the winged submersible, according to an illustrative embodiment of the present invention.

Each winged submersible cockpit (pressure pod) has two O2 make-up systems (for redundancy), and each is connected to an external 80-cubic-foot oxygen supply. Note that each 1,000 psi represents 24 man-hours.

In each cockpit, one system (either port or starboard) can be selected by turning on (one-half-turn counter-clockwise) the High Pressure (HP) valve. The flow rate from the regulator is then adjusted between 0 and 1.5 liters/minute in 0.1 l/m increments. Typically a pilot will use about 0.5 liters/min.

In operation, the flow is adjusted on an as-needed basis to maintain O2 readings and cabin pressure within target limits.

Regarding the target operating range, the reading should be as follows: O2 "green" reading between 19–24. CP can vary from −10 mb below atmospheric pressure to +30 mb greater, i.e., actual cabin pressure could read 990 mb to 1030 mb if the starting point were 1000 mb.

Regarding abort limits, the reading should be as follows: O2 "green" reading between 17–28. CP minimum −30 mb below atmospheric pressure to +50 mb greater.

It is important to note that the exemplary use of the upper oxygen (abort) limit described herein is actually not based on human physiology; there are certain dive systems and medical treatments that operate with 100 percent oxygen at one atmosphere. The upper limit described has the advantage that it lessens greatly the danger of flammability and fire risk.

To be hazardous, both fuel and source of ignition need to be present. Conventional certified submersibles typically contend with high-powered electric circuits in the cabin (a source of ignition) as well as propulsion batteries (which can create hazards through acid-seawater reaction.) Consequently, current ABS certification requirements set a 23 percent maximum oxygen content within a submersible cabin to keep the environment safe when allowing internal propulsion batteries, high current switching, and so forth inside the habitable compartment.

However, the illustrative embodiment of the winged submersible exceeds ABS certification requirements in this respect, since it is not desirable to have hazardous material or a high electrical power level in the pressure hull.

Consequently, the illustrative embodiment of the winged submersible follows a much more conservative practice of eliminating internal batteries and power management that could pose any sort of fire hazard. This design places all high-power current management "in the wet" area outside the pressure hulls, removing the primary source of ignition.

In addition, the pods' internal power preferably is limited to 7 or 4 amps, which is intrinsically safe.

Figure 19:
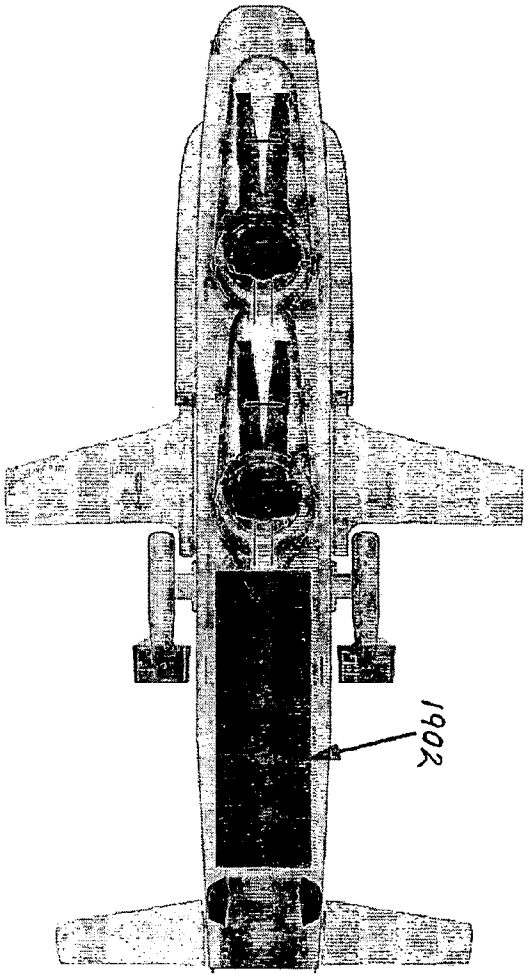
FIG. 19 is a diagram illustrating a batteries, gas bottles, and electronic area 1902 of a winged submersible, according to an illustrative embodiment of the present invention.

FIG. 19 is a diagram illustrating a batteries, gas bottles, and electronic area 1902 of a winged submersible, according to an illustrative embodiment of the present invention. All batteries, gas bottles and major electronic components are housed in the area 1902 outside the individual pressure hulls for safety. Of course, other arrangements are possible, including having such equipment housed within the pressure hull(s), given a current mission of the submersible and other considerations, all while maintaining the spirit and scope of the present invention.

A description will now be given of communication systems employed by the winged submersible, according to an illustrative embodiment of the present invention. It is to be appreciated that the present invention is not solely limited to the communications equipment, technologies, hand signals, code words, and so forth described herein. That is, given the teachings of the present invention provided herein, one of ordinary skill in the related art will contemplate these and various other communications equipment, technologies, hand signals, code words, and so forth with respect to the winged submersible, all while maintaining the spirit of the present invention.

According to the illustrative embodiment, the primary surface communication for winged submersible operations is VHF marine radio. UQC (described below) is used for communication between the submerged craft and the surface. Both winged submersible cockpits carry VHF transceivers (usually with redundant backup), and one or both cockpits will carry UQC transceivers.

In general, standard marine radio protocol is used for all winged submersible operations, with the exception of submerged VHF coms between the forward and aft cockpits (since no one else can hear, station identification can be omitted). Anyone unfamiliar with VHF protocol should obtain a guide available from a marine store, or check the Internet at www.robin-wood.com/USCGAUX.

Regarding inter-pod and surface net, the current, but not mandatory, configuration is for each pilot to be issued with self-contained (battery powered) VHF radio/VOX system (optional) and lightweight headsets. This is used for inter-pod communications. The VOX works well and radio call signs are dispensed with as no one else can tune in when the craft is submerged. On the surface, the same VHF system allows three-way communication between each winged submersible crewmember and the surface support crew. The marine VHF protocols also enable the crew to communicate with surface traffic if needed.

In accordance with an embodiment of the invention, winged submersible operations use VHF (marine) radio channel 69 (typically) for general communications (prior to each operation, a net frequency is assigned). Other acceptable frequencies may be used without departing from the spirit of the invention.

Underwater communications (UQC) may also be employed. For deeper dives, each pod and one or both crewmembers can also be issued an OTS SSB 1001 (through water) communication set. These use conventional headsets, with the PTT (push to talk) button on the left headphone.

The surface support crew can have a more powerful Orcatron base unit; the common channel used is 7 (and only 7) on the SSB, which corresponds to 27 KHz (side band) on the Orcatron. If there is a common communication frequency underwater (for civilian and military craft) this is it. Other channels on the SSB may be used locally to communicate with divers, etc.

The SSB 1001 units have a hands-free setup system, using a computerized female voice that takes an operator through the options, and either a double or triple tap of the PPT button to select the various options.

A description will now be given of normal operations and emergency procedures relating to the winged submersible, according to an illustrative embodiment of the present invention. It is to be appreciated that the present invention is not solely limited to the preceding operator steps and corresponding equipment with respect to normal and emergency operations. That is, given the teachings of the present invention provided herein, one of ordinary skill in the related art will contemplate these and various other operator steps and corresponding equipment with respect to normal and emergency operations of the winged submersible, all while maintaining the spirit of the present invention.

As a reminder: under most conditions, the winged submersible is operated under fail-safe conditions of fixed positive buoyancy. This simplifies operations and is intrinsically safer than conventional submersibles running under variable buoyancy. In addition, it eliminates the need for a back-up emergency drop weight. If power is lost, the entire submersible automatically returns to the surface.

In contemplated future operational modes, the winged submersible may be expanded to include neutrally buoyant operations for specialized tasks. In this operational mode, a minimum weight, for example 100 lbs, of nose ballast may be transferred to the emergency drop weight mechanism (again, when operated with fixed positive buoyancy the drop weight is not necessary).

A description will now be given of a powered emergency ascent.

The preferred emergency surfacing configuration is to power the submersible back using 40–50 percent thrust in a powered climb, with a maximum 35 degrees nose-up angle.

The lift of the submersible in such a configuration will be extremely powerful, since positive buoyancy, thrust vector and wing lift all combine. Estimated time ascent rate under the above conditions will be approximately 250 feet per minute. This is many times faster than conventional minisub ascent rates, allowing for a return from maximum operating depth of 1,500 feet in six minutes. This ascent rate is more than adequate for life support anomalies or possible water leakage.

Although the fastest possible ascent rate would be with a vertical climb, the wings do not assist this. Hence, if the pilot believes the submersible is gaining weight for any reason, a shallower climb will allow the wings to provide any extra lift required. Consequently, it's preferable to increase thrust rather than attempt a steeper ascent. A further consideration favoring a 30 degree climb is that any water leakage into the pods has less chance of damaging electrical systems if the submersible is flown smoothly at 30 degrees nose-up.

A description will now be given of unpowered emergency ascent.

The obvious need for an unpowered emergency ascent is loss of thrust or flight control. Under these conditions simply allowing the natural (positive) buoyancy to return the submersible to the surface is all required.

A description will now be given of an emergency exit involving gas bags and dome pins, according to an illustrative embodiment of the present invention.

The gas bags are designed to add massive surface buoyancy only in an emergency, further allowing (only if necessary) one or both crewmembers to open the hatches and exit the submersible. The bags can be readily deployed (by actuating the emergency gas bag switch 1416) and the submersible towed back with the crew in the pods without impacting near-term operations.

Note the displacement and distribution of bags is designed to allow the crew to exit with sea conditions that might actually flood the pods.

To deploy the gas bags, the following is performed: turn the Emergency Gas Bag inflation valve 1416 (located behind operator's right shoulder) through 90 degrees and leave the valve in the inflated position. See FIG. 14. The bags should blow off their covers in 5 seconds and inflate fully in about 60 seconds. Inflation can be initiated on or just below the surface. The bags are bright red for surface visibility.

It is to be appreciated that the present invention is not limited solely to the emergency gas bags described herein to provide/add massive surface buoyancy in an emergency and, thus, other approaches may also be employed while maintaining the spirit of the present invention. For example, surface ballast tanks and other approaches may also be employed to provide/add massive surface buoyancy in an emergency or other situation.

A further description will now be given of the pressure pods of the winged submersible, according to an illustrative embodiment of the present invention. It is to be appreciated that the present invention is not solely limited to the preceding materials and other design details relating to the pressure pods. That is, given the teachings of the present invention provided herein, one of ordinary skill in the related art will contemplate these and various other materials and design details relating to the pressure pods of the winged submersible, all while maintaining the spirit of the present invention.

As described above, in the illustrative embodiment, the two cockpits (pressure pods) are each self-contained sealed diving units more like form-fitting, hard-shell Atmospheric Diving Suits than conventional submersible pressure hulls. This frees the external winged submersible hull design from the usual bulk, poor distribution of payload and large cross-sectional area (fluid drag) of a conventional pressure hull. More important, this design gives each crewmember individual control and responsibility for the operation of his or her individual pressure pod, including management of life support systems, communications, and so on. Of course, other configurations are available, including for example, configurations in which the pilot has control over all systems for all pods.

The pressure hull geometry breaks away from conventional simple (stress efficient) spheres or cylinders. The design priorities were to push submersible flight to its practical limits with consideration given to human ergonomics, safety and comfort.

For the pressure hulls, sand-cast aluminum is preferred but not mandatory. Aluminum is preferred in the case that when "pushing depth" is a low priority. For other reasons readily contemplated by one of ordinary skill in the related art including, but not limited to, pushing depth having a higher priority, other materials may be employed for the pressure hulls. Aluminum is preferred in the above embodiment due to its reliability and proven track record in manufacture, testing, quality control, and so on. Aluminum further has a great deal of known engineering strengths and weaknesses when used under pressure. The stresses put on to the pressure pods were able to then be calculated so that the pods could be designed to eliminate the worst-case problem faced by submersibles: hull failure brought on by too much water pressure.

There are two basic forms of pressure-related hull failure: simple over-stress failure, and "elastic instability" where a thin wall buckles prematurely. Elastic instability is a complex issue that can be avoided by choosing aluminum, with correspondingly thick (stable) walls. Aluminum is also a lighter material than steel, and easier and less expensive to work with than a more exotic material, such as titanium or ceramic.

Lastly, pressure hulls can be optimized by reducing weight to a uniform (limiting) stress. With the illustrative embodiment of the winged submersible, the pods were "over-built", and the depth rating defined by the one area (forward of the operator's chin) that was the natural stress riser because of the human form geometry. This provides the advantage of knowing where to concentrate the casting design, quality control (QC) and strain gauge analysis to confirm both QC and verify the stress modeling. However, it is to be appreciated that other designs and materials may be employed for the pressure hulls including, but not limited to, titanium, ceramic, steel, composites, plastic (molded, cast, etc.), and so forth. Returning to composites, a composite hull molded with resin and chopped fiber reinforcement would be a preferred but not mandatory implementation.

Also, it is to be further appreciated that for any material, the cost of maintaining an acceptable level of optical clarity in the entire dome of a pressure pod is significantly more expensive than providing the acceptable level of optical clarity in a smaller portion of the dome. Thus, it is preferable, but not mandatory, that the pod is arranged such that an operator is positioned (e.g., in a recumbent position) so as to look through a pre-designated area or portion of the dome that intentionally includes an acceptable or otherwise pre-designated level of optical clarity otherwise omitted from (most if not all of) the remainder of the dome, as opposed to the entire dome having such clarity. Optimally, the eyes are close to the center of the spherical sector for minimum distortion. In this way, unnecessary or otherwise undesirable cost in the manufacturing process of the domes with respect to providing full clarity is avoided and/or reduced. In such a case, it is preferable, but not mandatory, that the pre-designated area or portion of the dome that includes the acceptable or otherwise pre-designated level of optical clarity be disposed at a central portion of the dome and for 360 degrees. Of course, given that a 5-point harness may be employed to secure a diver to his or her seat within the pod, which would lessen that diver's ability to look directly backward (i.e., in the reverse direction) through the dome, less than 360 degrees is also acceptable.

A description will now be given of pressure hull testing.

Based on American Boating Standard (ABS), the design of the illustrative embodiment of the winged submersible hulls meets or exceeds requirements for a manned rating of 1,500 fsw (feet of sea water). Both hulls were pressurized to a depth of 1,875 feet (1.25 times 1,500 feet), with material strains still less than the elastic limit of the material. Having passed a "proof dive" to 1,875 feet, the winged submersible is considered, serial #001, proven for manned operation to no greater than 1,500 feet.

Again, the safety factors at the controlling area conform to conventional ABS guidelines, but elsewhere the requirements have been exceeded (for example, although the maximum operational depth of the winged submersible is 1,500 feet, the acrylic domes could be rated to over 2000 feet by ABS standards).

A description will now be given of a manual versus an automatic Life Support System (LSS) for the winged submersible.

In the preferred embodiment, the winged submersible uses a fully manually-adjusted life support system (LSS) rather than an automatic system. However, given other applications for which a submersible in accordance with the present invention may be employed as well as the teachings of the present invention provided herein, some embodiments of the present invention may use an automatic life support system in addition to, or in place of, the manual system described herein, all while maintaining the spirit of the present invention.

Automatic LSS's are the norm on conventional submersible craft, including the first WASP (1978.) However, they need the same care and set-up procedures as a manual system and absolutely the same knowledge and competence to operate in manual mode if the automatic system fails.

The manual system installed on the winged submersible reduces a one atmospheric re-breather to its simplest (most reliable) essence, and exposes the pilot to the core issues that would be the same for space EVA suits, Atmospheric Diving Suits (ADS) and all future Deep Flight craft without depth limit.

A description will now be given of manual versus fly-by-wire flight controls for the winged submersible.

The illustrative embodiment of the winged submersible includes a carefully crafted set of low friction, rotary control pressure hull breakthroughs (these are subject to the pressure differential) for a manual mechanical linkage between the joysticks, ailerons and elevators, and between the rudder bar and vertical stabilizers (rudders).

The difference in approach is analogous to the difference between an automatic transmission luxury car with power steering, versus a stick-shift sports car with manual steering. The former might be more comfortable, but the latter is more fun to drive, and you get a better "feel" for the road (or in our case, the water). There is no substitute for literally muscling the submersible through maneuvers, and the feel, feedback and pure operational reliability and maintainability of this design is a joy.

However, having said that, for future craft running at greater depths (with a vastly-increased pressure differential), the manual system may be replaced by a fly-by-wire system. That is, it is to be appreciated that the present invention is not limited to manual or fly-by-wire flight controls and, thus, other types of flight controls may be employed by a submersible in accordance with the present invention, all while maintaining the spirit of the present invention.

A description will now be given of the low voltage EV propulsion system of the winged submersible, according to an illustrative embodiment of the present invention. It is to be appreciated that while electrically powered motors are described herein with respect to the winged submersible, other types of motors may also be employed while maintaining the spirit of the present invention. For example, a steam turbine engine, a closed cycle IC engine, a hydrogen-oxygen engine with exhaust (water) condensed and pumped out against ambient pressure, and so forth, may be employed to power the winged submersible.

For the illustrative embodiment of the winged submersible, the custom high-powered amplifiers and electric motor system (up to 150 Volts) were not used. Instead, we switched to off-the-shelf electrical components derived for the new electric vehicle (EV) market. The thruster motors are housed in a custom thruster package (designed by John Vance) that includes a planetary gearbox and pressurized oil bath shaft seal. The motor runs dry at one atmosphere.

This also provides a lower risk of electric shock for crewmembers maintaining the sub, enabling the use of a lower risk, low (24/48) voltage system, thereby eliminating the voltage safety interlocks and sensors of previous submersibles.

Finally, as with all Hawkes-designed subs, the high-powered electronics have been placed outside the pressure hulls (pods). The winged submersible has port and starboard electronic bottles (behind the battery) that each control one thruster and provide redundant isolated and current limited 12/24 V power to the pods.

A description will now be given of the propulsion batteries of the winged submersible. Of course, the present invention is not solely limited to the preceding battery arrangement and other arrangements may be employed by a winged submersible in accordance with the present invention, while maintaining the spirit of the present invention. The illustrative embodiment's batteries consist of four encapsulated 6V traction (lead acid) batteries that are pressure-compensated by oil. Again, this is a simple robust approach rather than overly "exotic" and high-tech. The resulting 24 V traction battery is actually divided into two, to give redundant electrical service to the pods for the CO2 scrubbers and for communications. By dividing the main battery into two battery systems (except for the oil compensation), redundancy is provided for important internal services.

A description will now be given of the battery capacity of the illustrative embodiment of the winged submersible. The battery pack is not overly large at close to 400 amp-hours, but is intended to be quickly changed out for a fresh propulsion battery (if necessary) between dives. The batteries will last four hours under normal operations.

A description will now be given of the external lights of the winged submersible. Of course, the present invention is not solely limited to the preceding lighting arrangement and other lighting arrangements may be employed by a winged submersible in accordance with the present invention, while maintaining the spirit of the present invention. A separate electronics bottle (EB) provides 120 V A/C service to the main arc lights. As fitted, these are very efficient new lights (Sea Arcs 5000), from Deep Sea Power and Light, but they do operate at 120 V A/C and so need to remain OFF (for safety) when the submersible is being handled externally or is closely approached by a diver.

In alternative future embodiments, a lower-light-level illumination will be used with night vision equipment and camera systems, enabling one to "sneak up" on elusive, light-sensitive creatures, such as the giant squid.

The switch to mechanical control system and off-the-shelf EV motors and controllers enabled a significant overall reduction in basic vehicle electronics and complexity. This philosophy was followed even to the extent of using mechanical (artificial horizon) pitch and roll instrumentation. Note, while electronics are intrinsically reliable, subsea connectors and wiring are not, so the winged submersible generates significant robustness and field maintainability from a very deliberate minimizing of exposed electrical connectors and wiring.

A description will now be given of the power pod supplies of the illustrative embodiment of the winged submersible. Each of the two main EB's tap into different sides of the main battery and feed redundant 12 V isolated (7 amp regulated) power supplies through different cables and penetrations into the two pods. The 12 V (Switch "P" on the internal control console) is used for the CO2 scrubber, communications and flight controls. This redundancy enables the pods to dispense with the bulk (and hazard) of internal emergency batteries.

A description will now be given of an un-powered operation of the winged submersible.

A further unique advantage to this design is that one can return the winged submersible to the surface even if the power cuts out completely (in aviation terms, a "dead stick" landing, wherein you use certain airplane's gliding ability to land the craft). Other interesting application would be using un-powered ascending flight (or stealth mode) when we search for sensitive animals, such as giant squid.

For maximum safety and reliability, we have designed the illustrative embodiment of the winged submersible with proven technology and components, robust mechanical systems replacing potentially fragile electronic components (e.g., the attitude indicator and back-up depth gauge are mechanical), redundant power supplies (primary inter-pod and surface communications are independent using self-powered VHF communications), manually-operated systems (including some life support; you can operate the CO2 scrubber with lung power by breathing through a mask), and inherent positive buoyancy (you can pilot the winged submersible through an un-powered gliding ascent, if necessary.)

Although the illustrative embodiments have been described herein with reference to the accompanying drawings, it is to be understood that the present invention is not limited to those precise embodiments, and that various other changes and modifications may be affected therein by one of ordinary skill in the related art without departing from the scope or spirit of the invention. All such changes and modifications are intended to be included within the scope of the invention as defined by the appended claims.

What is claimed is:

1. A submersible comprising:

a hull having at least one pressure pod for accommodating at least one person; and at least one pair of fixed wings disposed on the hull, said wings having ailerons that are movable in opposite directions with respect to each other to provide the submersible with the ability to roll;

wherein the submersible does not include a ballast tank and has a fixed positive buoyancy and a fixed center of buoyancy of the submersible that is in close proximity to the center of gravity.

2. The submersible according to claim 1, further comprising at least one elevator disposed on the hull, said at least one elevator being movable to provide the submersible with the ability to elevate and decline.

3. The submersible according to claim 1, further comprising steering means connected to said hull for providing the submersible with the ability to steer right and left.

4. The submersible according to claim 1, wherein said at least one pressure pod is separate from and contained within the hull of the submersible.

5. The submersible according to claim 4, wherein the at least one pressure pod comprises a composite structure made from a resin and fibers.

6. The submersible according to claim 1, further comprising a central longitudinal axis, said at least one pair of wings providing the submersible with a rolling range of up to 60 degrees in either direction around said longitudinal axis.

7. The submersible according to claim 1, further comprising a central longitudinal axis, said at least one pair of wings providing the submersible with a rolling range of up to 60 degrees in either direction around said longitudinal axis.

8. The submersible according to claim 1, further comprising a central longitudinal axis, said at least one pair of wings providing the submersible with a rolling range of up to 90 degrees in either direction around said longitudinal axis.

9. The submersible according to claim 1, further comprising a central longitudinal axis, said at least one pair of wings providing the submersible with the ability to roll 360 degrees in either direction around said longitudinal axis.

10. The submersible according to claim 1, wherein said at least one pressure pod accommodates at least two persons.

11. The submersible according to claim 1, wherein said at least one pressure pod accommodates at least three persons.

12. The submersible according to claim 1, further comprising at least two pressure pods for accommodating at least two persons.

13. The submersible according to claim 1, further comprising three pressure pods for accommodating at least three persons.

14. A submersible comprising:

a hull having at least one pressure pod for accommodating at least one person; and at least one pair of fixed wings having ailerons disposed on the hull;

wherein said at least one pressure pod is maintained at a constant pressure, said constant pressure providing the submersible with a positive buoyancy;

wherein the submersible does not include a ballast tank and has a fixed positive buoyancy and a fixed center of buoyancy of the submersible is in close proximity to the center of gravity.

15. The submersible according to claim 14, further comprising:

a thruster for providing forward thrust to the submersible; and at least one elevator disposed on the hull;

wherein said ailerons and said at least one elevator are independently adjustable with respect to each other.

16. The submersible according to claim 15, wherein said at least one pair of wings are structured to generate a balancing downward force in response to forward movement of the submersible to counteract the positive buoyancy of the submersible.

17. The submersible according to claim 16, wherein the downward force generated by the wings increases as the speed of the submersible increases.

18. The submersible according to claim 14, wherein said at least one pressure pod is separate from and contained within the hull of the submersible.

19. The submersible according to claim 14, further comprising a dome access hatch for said at least one pressure pod.

20. The submersible according to claim 15, further comprising a life support system connected to the at least one pressure pod for providing life support to an interior of the pressure pod.

21. The submersible according to claim 14, further comprising at least one emergency airbag for providing increased flotation when deployed.

22. The submersible according to claim 14, wherein said at least one pressure pod accommodates at least two persons.

23. The submersible according to claim 14, wherein said at least one pressure pod accommodates at least three persons.

24. The submersible according to claim 14, further comprising at least two pressure pods for accommodating at least two persons.

25. The submersible according to claim 14, further comprising three pressure pods for accommodating at least three persons.

26. A submersible comprising:

a hull having at least one pressure pod for accommodating at least one person; and at least one pair of fixed wings having ailerons disposed on the hull;

wherein the at least one pressure pod is maintained at a substantially constant pressure and the submersible does not include a ballast tank and has a fixed positive buoyancy and a fixed center of buoyancy of the submersible is in close proximity to the center of gravity.

27. The submersible according to claim 26, further comprising:

a thruster for providing forward thrust to the submersible; and at least one elevator disposed on the hull, said at least one pair of wings and said at least on elevator being independently adjustable with respect to each other.

28. The submersible according to claim 27, wherein said at least one pair of wings are structured to generate a balancing downward force in response to forward movement of the submersible to counteract the neutral to positive buoyancy of the submersible.

29. The submersible according to claim 28, wherein the downward force generated by the wings increases as the speed of the submersible increases.

30. The submersible according to claim 26, wherein said at least one pressure pod is separate from and contained within the hull of the submersible.

31. The submersible according to claim 27, further comprising a dome access hatch for said at least one pressure pod.

32. The submersible according to claim 27, further comprising a life support system connected to the at least one pressure pod for providing life support to an interior of the at least one pressure chamber pod.

33. The submersible according to claim 26, further comprising at least one emergency airbag for providing increased flotation when deployed.

34. The submersible according to claim 26, wherein said at least one pressure pod accommodates at least two persons.

35. The submersible according to claim 26, wherein said at least one pressure pod accommodates at least three persons.

36. The submersible according to claim 26, further comprising at least two pressure pods for accommodating at least two persons.

37. The submersible according to claim 26, further comprising three pressure pods for accommodating at least three persons.

38. A submersible comprising:

a hull having at least one pressure pod for accommodating at least one person;

at least one pair of fixed wings disposed on the hull; and wherein said at least one pressure pod is capable of maintaining a substantially constant pressure and the submersible does not include a ballast tank and has a fixed positive buoyancy and a fixed center of buoyancy of the submersible that is in close proximity to the center of gravity.

39. The submersible according to claim 38, further comprising:

a thruster for providing forward thrust to the submersible; and at least one elevator disposed on the hull, wherein said ailerons and said at least one elevator are independently adjustable with respect to each other.

40. The submersible according to claim 38, wherein said constant pressure provides the submersible with a substantially fixed buoyancy.

41. The submersible according to claim 40, wherein said at least one pair of wings are structured to generate a balancing downward force in response to forward movement of the submersible to counteract the fixed buoyancy of the submersible.

42. The submersible according to claim 41, wherein the downward force generated by the wings increases as the speed of the submersible increases.

43. The submersible according to claim 38, wherein said at least one pressure pod is separate from and contained within the hull of the submersible.

44. The submersible according to claim 39, further comprising an acrylic dome access hatch for said at least one pressure pod.

45. The submersible according to claim 39, further comprising a life support system connected to the at least one pressure pod for providing life support to an interior of the at least one pressure pod.

46. The submersible according to claim 44, wherein said access hatch provides access to said at least one pressure pod while the submersible is in the water and further secures said at least one pressure pod at the constant pressure.

47. The submersible according to claim 38, further comprising at least one emergency airbag for providing increased flotation when deployed.

48. The submersible according to claim 38, wherein said at least one pressure pod accommodates at least two persons.

49. The submersible according to claim 38, wherein said at least one pressure pod accommodates at least three persons.

50. The submersible according to claim 38, further comprising at least two pressure pods for accommodating at least two persons.

51. The submersible according to claim 38, further comprising three pressure pods for accommodating at least three persons.

52. A submersible comprising:

a hull having at least one pressure pod for accommodating at least one person; and at least one pair of fixed wings having ailerons disposed on the hull;

wherein said at least one pressure pod is maintained at a constant pressure and the submersible does not include a ballast tank and has a fixed positive buoyancy and a fixed center of buoyancy of the submersible is in close proximity to the center of gravity.

53. The submersible according to claim 52, further comprising:

a thruster for providing forward thrust to the submersible; and at least one elevator disposed on the hull, wherein said ailerons and said at least one elevator being independently adjustable with respect to each other.

54. The submersible according to claim 52, wherein said constant pressure provides the submersible with a fixed buoyancy.

55. The submersible according to claim 53, wherein said at least one pair of wings are structured to generate a balancing downward force in response to forward movement fo the submersible to counteract the fixed buoyancy of the submersible.

56. The submersible according to claim 55, wherein the downward force generated by the wings increases as the speed of the submersible increases.

57. The submersible according to claim 52, wherein said at least one pressure pod is separate from and contained within the hull of the submersible.

58. The submersible according to claim 53, further comprising an acrylic dome access hatch for said at least one pressure pod, said access hatch providing access to said at least one pressure pod while the submersible is in the water and further securing said at least one pressure pod at the constant pressure.

59. The submersible according to claim 58, wherein said at least one pressure pod is structured to provide a recumbent sitting position for the at least one person.

60. The submersible according to claim 53, further comprising life support system connected to the at least one pressure pod for providing life support to an interior of the pressure pod.

61. The submersible according to claim 52, further comprising at least one emergency airbag for providing increased flotation when deployed.

62. The submersible according to claim 52, wherein said at least one pressure pod accommodates at least two persons.

63. The submersible according to claim 52, wherein said at least one pressure pod accommodates at least three persons.

64. The submersible according to claim 52, further comprising at least two pressure pods for accommodating at least two persons.

65. The submersible according to claim 52, further comprising three pressure pods for accommodating at least three persons.

66. A submersible comprising:

a hull having at least one pressure pod for accommodating at least one person;

at least one pair of wings having ailerons disposed on the hull; and and acrylic dome access hatch to said at least one pressure pod, said acrylic dome access hatch providing access to said at least one pressure pod while the submersible is in the water;

wherein said at least one pressure pod is maintained at a constant pressure of 1.0 Atmosphere and the submersible does not include a ballast tank and has a fixed positive buoyancy and a fixed center of buoyancy of the submersible that is in close proximity to the center of gravity.

67. The submersible according to claim 66, further comprising:

a thruster for providing forward thrust to the submersible; and at least one elevator disposed on the hull, wherein said ailerons and said at least one elevator are independently adjustable with respect to each other.

68. The submersible according to claim 67, wherein said constant pressure provides the submersible with a substantially fixed buoyancy.

69. The submersible according to claim 68, wherein said at least one pair of wings are structured to generate a balancing downward force in response to forward movement of the submersible to counteract the fixed buoyancy of the submersible.

70. The submersible according to claim 68, wherein the downward force generated by the wings increases as the speed of the submersible increases.

71. The submersible according to claim 66, wherein said at least one pressure pod is separate from and contained within the hull of the submersible.

72. The submersible according to claim 67, further comprising a life support system connected to the at least one pressure pod for providing life support to an interior of the pressure chamber pod.

73. The submersible according to claim 67, further comprising at least one emergency airbag for providing increased flotation when deployed.

74. The submersible according to claim 66, wherein said at least one pressure pod accommodates at least two persons.

75. The submersible according to claim 66, wherein said at least one pressure pod accommodating at least three persons.

76. The submersible according to claim 66, further comprising at least two pressure pods for accommodating at least two persons.

77. The submersible according to claim 66, further comprising three pressure pods for accommodating at least three persons.

78. A submersible comprising:

a hull having at least one pressure pod for accommodating at least one person, wherein said at least one pressure pod is maintained at a constant pressure;

at least one pair of fixed wings having ailerons disposed on the hull; and a life support system connected to said at least one pressure pod for providing life support systems to said at least one pressure pod;

wherein the submersible does not include a ballast tank and has a fixed positive buoyancy and a fixed center of buoyancy of the submersible is in close proximity to the center of gravity.

79. The submersible according to claim 78, further comprising:

a thruster for providing forward thrust to the submersible; and at least one elevator disposed on the hull;

wherein said at least one pair of wings and said at least one elevator are independently adjustable with respect to each other.

80. The submersible according to claim 78, wherein said constant pressure provides the submersible with a substantially fixed buoyancy.

81. The submersible according to claim 80, wherein said at least one pair of wings are structured to generate a balancing downward force in response to forward movement of the submersible to counteract the fixed buoyancy of the submersible.

82. The submersible according to claim 81, wherein the downward force generated by the wings increases as the speed of the submersible increases.

83. The submersible according to claim 78, wherein said at least one pressure pod is separate from and contained within the hull of the submersible.

84. The submersible according to claim 78, further comprising a dome access hatch for said at least one pressure pod.

85. The submersible according claim 78, further comprising at least one emergency airbag for providing increased flotation when deployed.

86. The submersible according to claim 78, wherein said at least one pressure pod accommodates at least two persons.

87. The submersible according to claim 78, wherein said at least one pressure pod accommodates at least three persons.

88. The submersible according to claim 78, further comprising at least two pressure pods for accommodating at least two persons.

89. The submersible according to claim 78, further comprising at least three pressure pods for accommodating at least three persons.

* * * * *